United States Patent [19]

Ohdai et al.

[11] Patent Number: 4,893,491

[45] Date of Patent: Jan. 16, 1990

[54] APPARATUS FOR FORMING COIL SPRINGS

[75] Inventors: Yozo Ohdai, Kasugai; Norifumi Abiru, Owariasahi; Eiji Ohbayashi, Kuwana, all of Japan

[73] Assignee: Asahi-Seiki Manufacturing Co., Ltd., Aichi, Japan

[21] Appl. No.: 169,048

[22] Filed: Mar. 16, 1988

[30] Foreign Application Priority Data

Mar. 30, 1987 [JP] Japan ..... 62-47491[U]

[51] Int. Cl.[4] ..... B21F 3/02; B21F 35/02

[52] U.S. Cl. ..... 72/137; 72/138

[58] Field of Search ..... 72/130, 131, 132, 137, 72/138, 307; 140/71 R, 103, 104

[56] References Cited

U.S. PATENT DOCUMENTS 2,134,469 10/1938 Bergevin ..... 72/137 X
3,493,016 2/1970 Ott ..... 140/71 R
4,227,392 10/1980 Itaya ..... 72/137
4,555,924 12/1985 Remy et al. ..... 72/307
4,665,731 5/1987 Yagi et al. ..... 72/307
4,799,373 1/1989 Benton ..... 72/307

FOREIGN PATENT DOCUMENTS 56-12379 3/1981 Japan .

*Primary Examiner*—E. Michael Combs
*Attorney, Agent, or Firm*—Oliff & Berridge

[57] ABSTRACT

A method of forming coil springs by means of a single forming tool comprising the steps of bending a wire feed from a quill by applying a forming surface of the tip of a forming tool to the wire fed, forming a straight portion be separating the forming surface from the wire, changing the direction of the forming surface by rotating the forming tool about the axis of the quill, and again applying the forming surface to the wire to bend it in a different direction. Subsequently, these steps are repeated to form a coil spring having hook portions and a coiled portion of predetermined configuration and size. In accordance with the present invention, since a single tool is used for a variety of tools, a simplified apparatus can be provided.

10 Claims, 23 Drawing Sheets

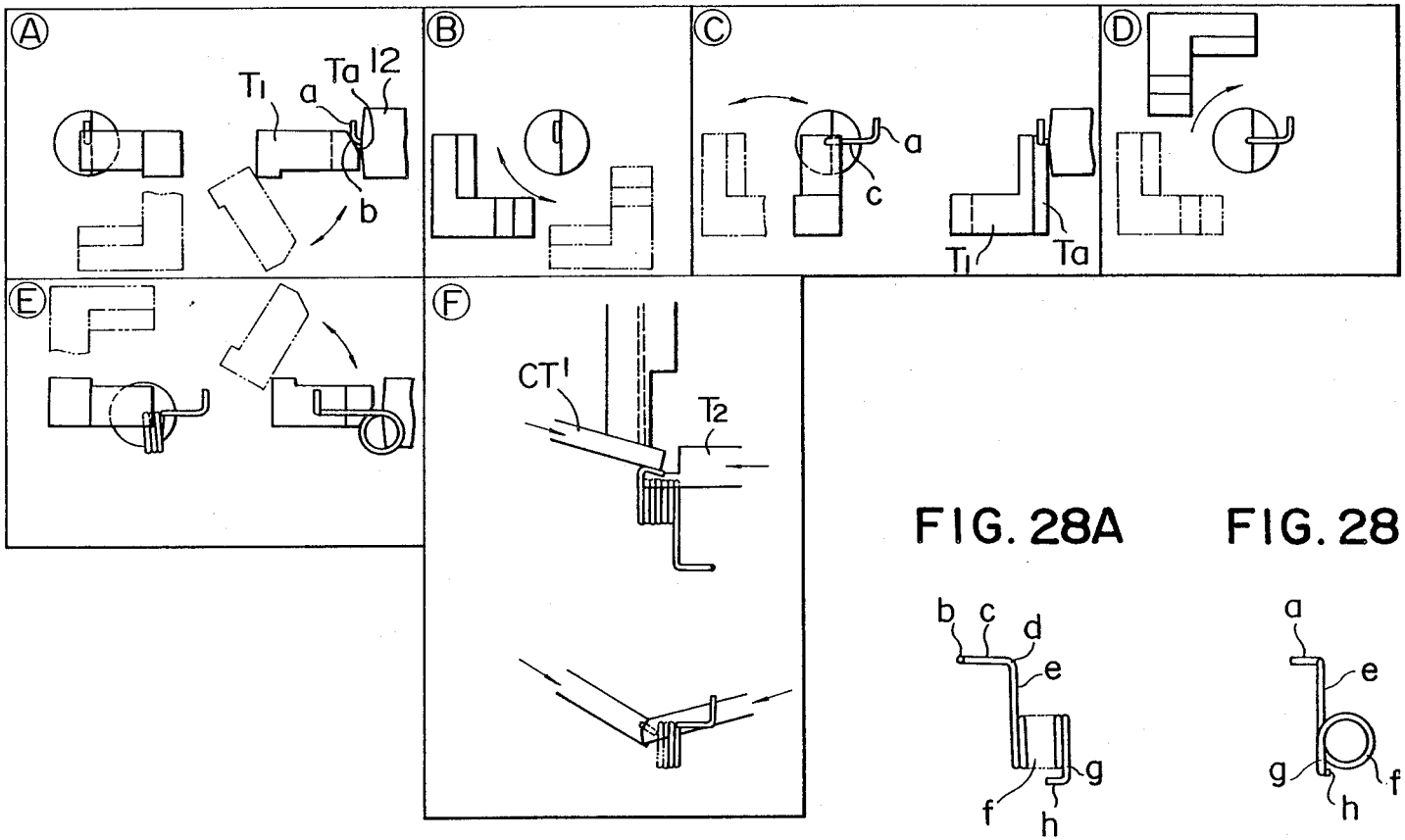
FIG. 26
FIG. 28A
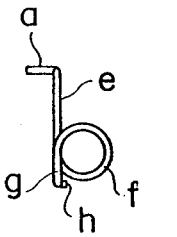
FIG. 28B

APPARATUS FOR FORMING COIL SPRINGS

BACKGROUND OF THE INVENTION

1.Field of the Invention

The present invention relates generally to a method of an apparatus for forming coil springs and, more particularly, to a method of and an apparatus for forming coiled portions, arcuated portions of hooks, or bent portions of various coils by applying a forming tool to a wire fed from a quill.

2. Description of the Prior Art

It is known that such a spring, for example, a torsion coil spring is produced in the following way. A plurality of forming tools are radially disposed around a wire fed from a quill, and the forming tools are sequentially moved toward and away from the wire in one-by-one fashion, whereby the individual forming tools are separately operated to form various portions of a spring such as an arcuated portion of a first hook, a bent portion between the first hook and a coiled portion and a body portion as well as a leading portion and an arcuated portion of a second hook.

However, since many such forming tools are constituted as separate units each including various components such as a tool holder and a drive mechanism, the cost of production is increased. Further, since a space for these forming units is limited on the front side of a tool mounting frame, a limited number of forming tools can only be mounted. As a result, it becomes difficult to form a spring having a complicated configuration, and the mechanism becomes complicated as a whole.

As disclosed in, for example, Japanese Examined Publication Pat. No. 56-12379, a conventional type of spring forming apparatus is typically arranged such that forming and cutting tools are directly driven by means of a single large gear, the operating timing of each of the forming and cutting tools being controlled by the rotation of the single large gear. However, drive cams associated with the forming tool require upward or downward slopes while they are rotating from working position to non-working position, or vice versa, and an angle at which each cam is driven depends upon the kind of spring to be formed. Therefore, if the number of forming tools excessively increases or the kind of spring to be formed is changed, it will become impossible to arrange the driving angles for all the cams during the rotation of the single large drive gear, and hence no proper timings can be set. For these reasons, since the number of tools used and angles required for forming are limited, the pattern of movement of a forming slide which holds a forming tool is limited, with the result that the movement pattern cannot be freely modified.

In addition, it is difficult to adjust the timing of each cam that is required to move forming and and cutting tools at proper timings, and therefore time-consuming and inefficient operations of correcting and gauging the configurations of the cams have been required for assembly thereof.

SUMMARY OF THE INVENTION

It is, therefore, an object of the present invention to provide a method of and an apparatus for forming coil springs, both of which can achieve a plurality of forming steps by means of a single forming tool to eliminate the above-described problems which may occur when coil springs are to be formed by using many forming tools.

To achieve the above object, there is provided, in accordance with one aspect of the present invention, a method of forming a coil spring, comprising the steps of:

bending a wire fed from a quill by causing a single forming tool having a forming surface at its one end to move forwardly to a position at which the forming surface is located close to the tip of the quill;

causing the forming tool to move backwardly to a position at which the forming surface is located away from the tip of the quill; and bending the wire fed from the quill in a different direction by rotating the forming tool about the axis of the quill through a predetermined angle, changing the direction of the forming surface, again moving the forming tool forwardly to the position at which the forming surface is located close to the tip of the quill, the aforesaid steps being sequentially repeated at a predetermined timing so that a coil spring having portions and a coiled portion with predetermined form and size are formed by the single forming tool.

In accordance with another aspect of the present invention, there is provided an apparatus for forming a coil spring, comprising:

a forming tool having a forming surface at its one end;

a tool assembly supported for forward and backward movements between a first position at which the forming surface is located close to the tip of a quill and a second position at which the forming surface is located away from the tip of the quill;

first drive means for causing the tool assembly to move between the first position and the second position;

second drive means for causing the tool assembly to rotate about the axis of the quill;

third drive means for feeding a wire from the tip of the quill; and control means for providing control so as to cause the first, second and third drive means to operate at predetermined timings.

It is another object of the present invention to provide a coil spring forming apparatus having a drive mechanism which is capable of readily and completely adjusting the timing of the motion of each cam for driving forming and cutting tools.

To achieve the above object, there is provided, in accordance with another aspect of the present invention, a coil spring forming apparatus comprising a forming tool unit and a cutting tool unit on the front side of a planar tool mounting frame and a pair of large drive gears which are disposed on the rear side of the planar tool mounting frame in such a manner that they are separately drivable and coaxially rotatable with respect to each other.

In a preferred embodiment of the present invention, a coil spring forming apparatus further comprises a central unit including a cutting/bending tool which is disposed on a support mounted on the front surface of a tool mounting frame in the vicinity of a central through-hole therein, with the angle of the support being adjustable and which is radially movable forwardly and backwardly along a guide way inclined toward the center of the through-hole; and a rear unit including a mandrel opposing the cutting/bending tool and movable forwardly and backwardly through the central through-hole of the tool mounting frame along a course extending from the rear side to the front side of the tool mounting frame, thereby bending a wire fed from a quill at a predetermined angle of twist in cooperation with the cutting/bending tool. Since this embodiment does not need many forming tools in forming springs having complicated configurations each having a different bending phase, the cost of production can be reduced.

The above and other objects, features, and functions of the present invention will be more readily apparent from the following description of a few preferred embodiments thereof when taken in conjunction with the accompanying diagrammatic drawings.

BRIEF DESCRIPTION OF THE DRAWINGS

FIG. 7 is a chart illustrating the manner of time sharing relative to the operation of cams, the feed of a wire and so on;

FIG. 26 is an illustration showing a process for forming a spring in accordance with the fourth embodiment;

FIGS. 28A and 28B are front and side elevations illustrating a torsion coil spring formed by the process shown in FIG. 26.

DESCRIPTION OF THE PREFERRED EMBODIMENTS

Preferred embodiments of the present invention will be described below wit reference to the accompanying drawings.

Figure 1:
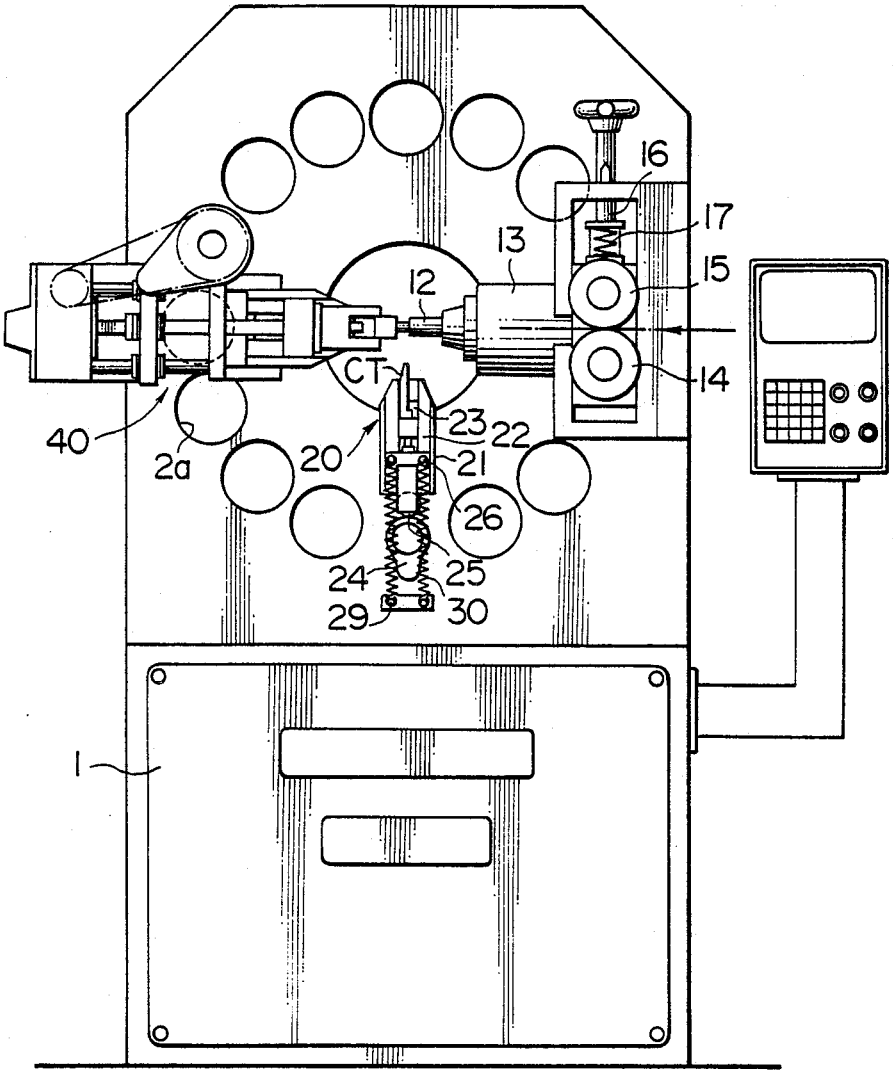
FIG. 1 is a diagrammatic front elevation of a coil forming apparatus according to a first preferred embodiment of the present invention.
Figure 2:
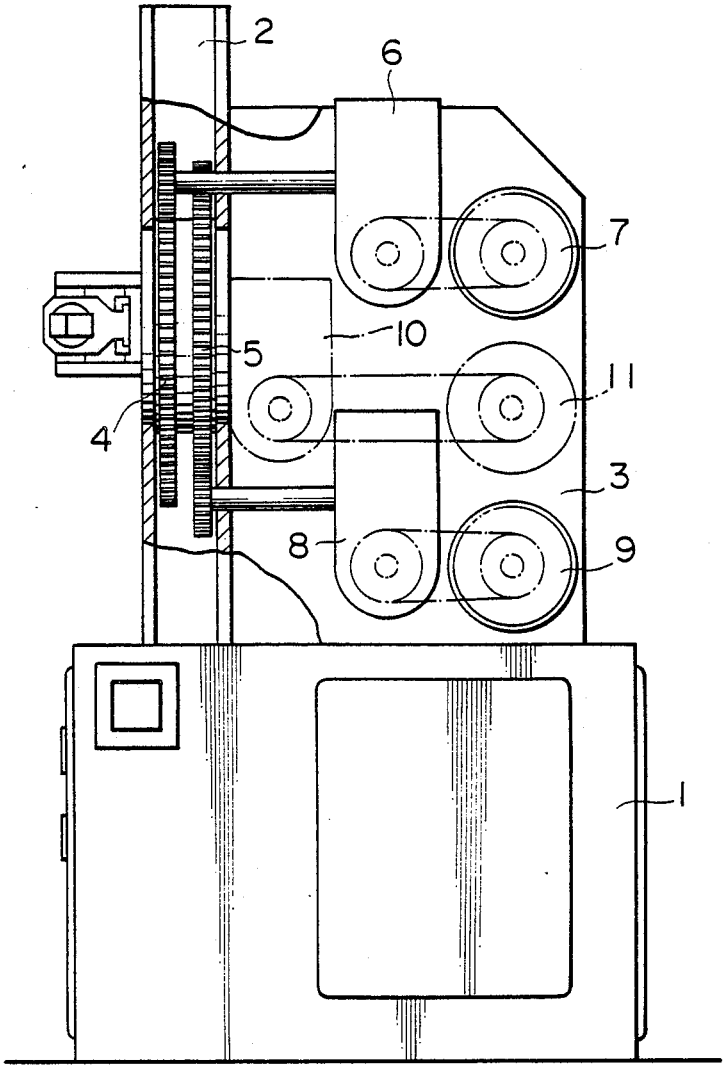
FIG. 2 is a diagrammatic side elevation, partially in cross section, of the apparatus shown in FIG. 1.

FIGS. 1 to 6 illustrate a first preferred embodiment of the present invention. In FIGS. 1 and 2, a base 1 carries a tool mounting frame 2 and a box 3 behind it. Large gears 4 and 5 are concentrically supported by the tool mounting frame 2 so as to rotate about respective axes separately from each other. The large gear 4 serves to rotate cams which cause swinging motion of a forming tool, while the large gear 5 serves to cause rotation of the forming tool. The box 3 includes a reduction gear 6 which is driven to rotate the large gear 4, a servo motor 7 for driving the reduction gear 6, a reduction gear 8 which is driven to rotate the large gear 5, a servo motor 9 for driving the reduction gear 8, a reduction gear 10 which is driven to rotate a wire feed roller (to be described later), and a servo motor 11 for driving the reduction gear 10. These servo motors are controlled by a numerical control device (not shown).

A quill 12 through which a wire is guided along a longitudinal bore is mounted on a mounting support 13 on the front side of the tool mounting frame 2. The longitudinal axis of the quill 12 extends in the radial direction of the large gears 4 and 5, and the tip of the quill 12 is located on the concentric axis of the large gears 4 and 5. At the rear of the quill 12, a wire feed roller 14 and a pressure roller 15 are disposed at positions above and below the center axis of the quill 12, respectively. The wire feed roller 14 has a circumferential surface around which a groove is formed, and is supported by the mounting support 13 for rotation about its axis. The wire feed roller 14 is caused to rotate by the servo motor 11 through the reduction gear 10. The pressure roller 15 is rotatably supported on a block which in turn is vertically movably supported on the mounting support 13. A spring 17 is held in compression between the pressure roller 15 and a spring receiver 16 which is disposed on the mounting support 13 to provide adjustment of the compression of the spring 17. The pressure roller 15 is pressed against the wire feed roller 14 by the resilient force of the spring 17. The leading end of a wire wound around a hoop (not shown) is clamped between the upper and lower rollers 15 and 14, and is fed from the quill 12.

At the front of the tool mounting frame 2, a cutting unit 20 is disposed in such a manner as to extend toward the center axis of the large gears 4 and 5 in the radial direction thereof. The cutting unit 20 is operated to cut off a desired position of the wire fed from the quill 12. A sliding member 22 is fitted into a guide support 21 which is radially mounted nearer to the axis. A tool holding member 23, whose position is radially adjustable, is fitted in a radially extending groove formed in the sliding member 22. A cutting tool CT is replacably disposed at the radially inner end of the tool holding member 23, and the cutting surface of the cutting tool CT is made to be flush with the end surface of the quill 12. A cam follower 25 is rotatably supported at the radially outer end of the sliding member 22, and two spring support pins 26 are disposed to project forwardly from the sliding member 22. A cam 24 is fixed to the shaft of a small gear which is rotatably fitted in the tool mounting frame 2 and which is meshed with the large gear 5. The cam 24 is adapted to be kept in contact with the cam follower 25 of the cutting unit 20. In order to keep the cam follower 25 in contact with the cam 24, a pair of springs 30 are held under tension between the spring support pins 26 which project forwardly from the sliding member 22 and two pins 29 which are disposed to project forwardly from the front surface of the tool mounting frame 2.

Figure 3:
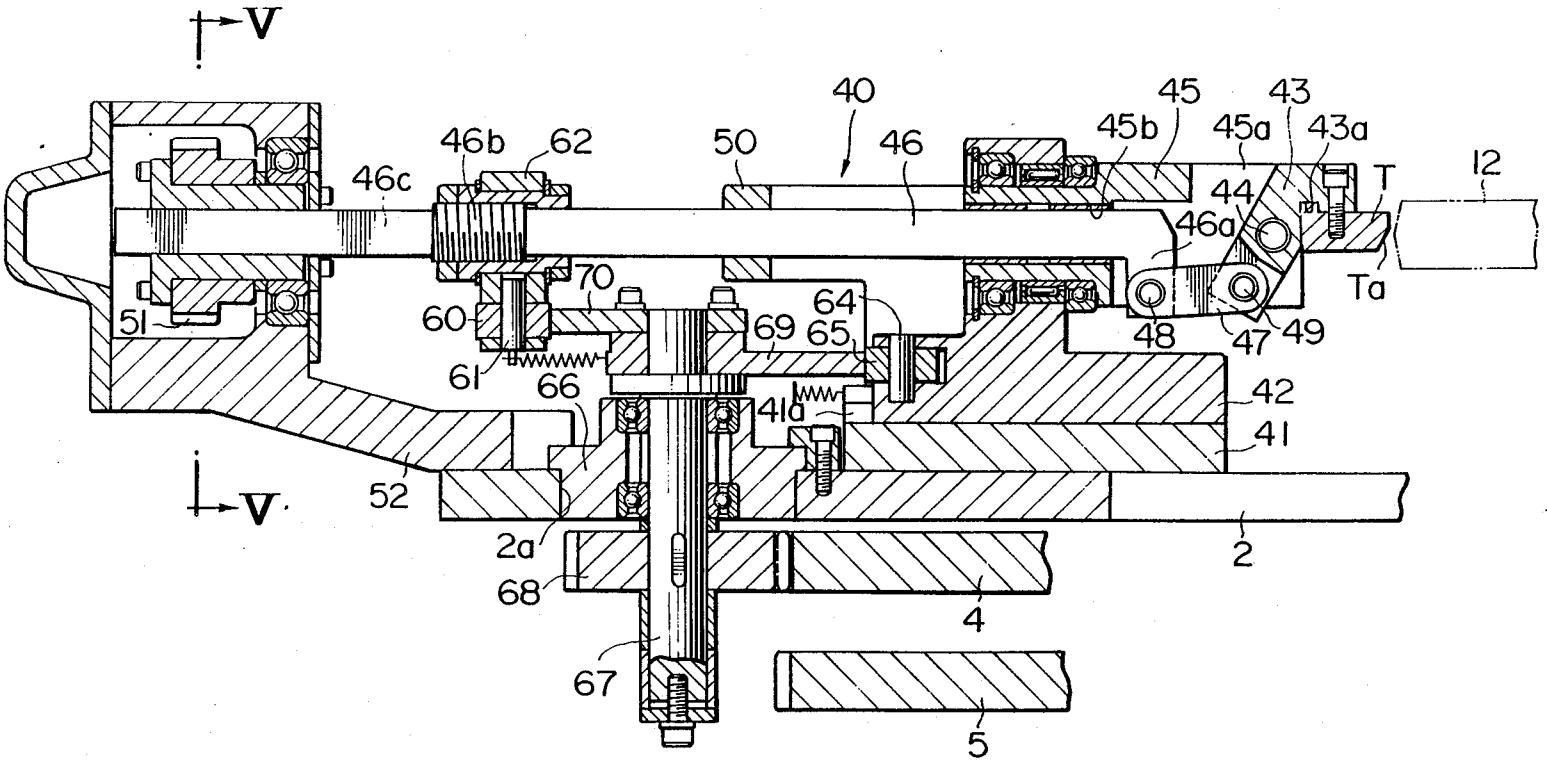
FIG. 3 is a diagrammatic vertical section of a forming tool unit incorporated in the first embodiment.
Figure 4:
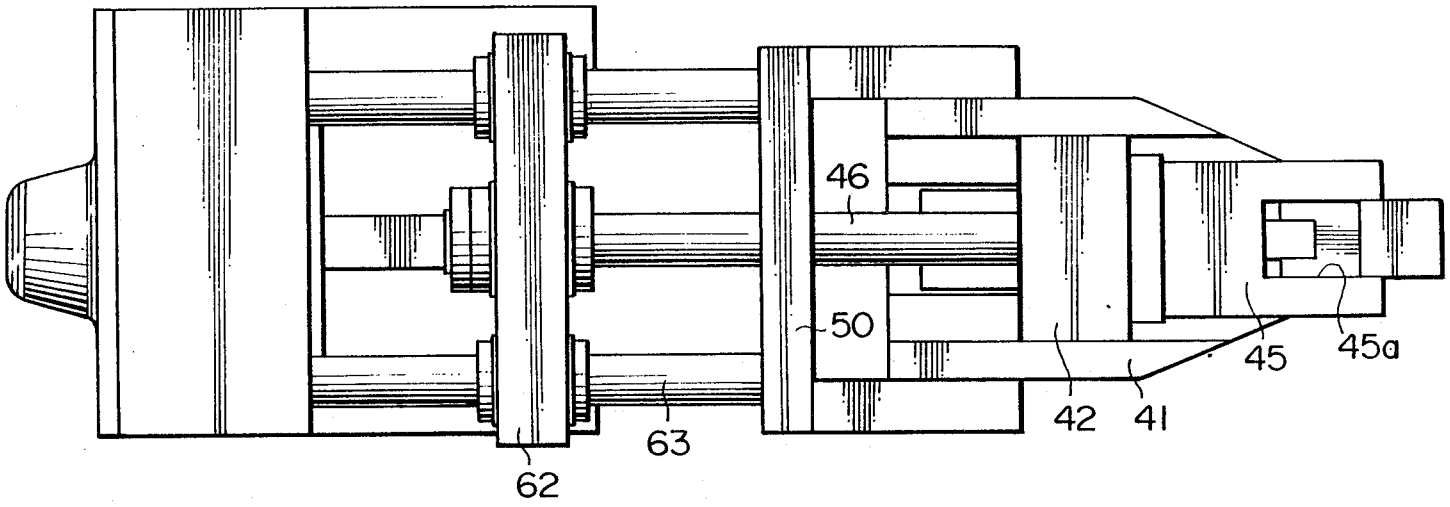
FIG. 4 is a diagrammatic plan view of the unit shown in FIG. 3.

At the front of the tool mounting frame 2, a forming unit 40 that is an essential feature of the present invention is aligned with the quill 12 in a face-to-face relationship. As shown in FIGS. 3 and 4, the forming unit 40 has a unit support 41, and the unit support 41 has a sliding guide surface 41*a* which is formed radially. A tool operating support 42 is slidably disposed on the sliding guide surface 41*a*. An operating cylinder 45 axially aligned with the quill 12 is journaled in a bearing mounted on the tool operating support 42. One end portion of the operating cylinder 45 on the side of the quill 12 is diametrically cut to provide a cutout 45*a* into which a tool holder 43 is inserted. The tool holder 43 is pivotally supported at its center by a support shaft 44 having an axis perpendicular to the longitudinal axis of the quill 12. An operating rod 46 is fitted into a slide bearing in a central bore 45*b* formed in the operating cylinder 45, in such a way that it can rotate about its longitudinal axis and move forward and backward therealong. An L-shaped end 46*a* (as viewed in FIG. 3) of the operating rod 46 nearer to the tip of the quill 12 and the adjacent end of the tool holder 43 are pivotally secured to pins 48 and 49, respectively, and the pins 48 and 49 are pivotally linked to each other by linkage members 47. An engagement groove 43*a* is formed at the other end of the tool holder 43, and a forming tool T is replaceably attached to the engagement groove 43*a*. A forming surface Ta that is inclined with respect to the longitudinal axis of the quill 12 is formed at the end of the forming tool T which faces the quill 12. The operating rod 46 is supported at a lengthwise mid portion by a bracket 50 mounted on the tool operating support 42. The rear end portion of the operating rod 46 is cut into a portion 46*c* having a rectangular cross section. An external-thread portion 46*b* is formed around a portion of the operating rod 46 that is before the rectangular rod portion 46*c*. A worm wheel 51 having a bore of a rectangular cross section is fitted onto the rectangular rod portion 46*c* for forward and backward movements with respect to the same. The worm wheel 51 is rotatably supported by a bearing mounted on a bracket 52 fastened to the tool mounting frame 2.

Figure 5:
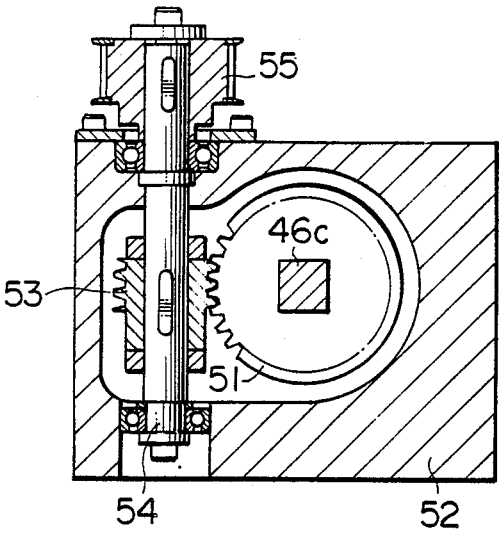
FIG. 5 is a cross section taken along the line V—V of FIG. 3.
Figure 6:
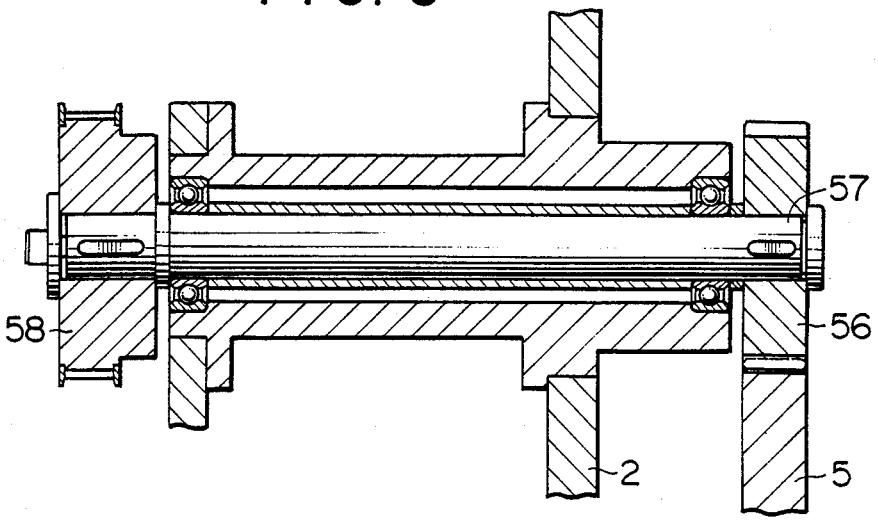
FIG. 6 is a diagrammatic vertical section illustrating a structure for supporting an intermediate gear meshed with a large gear in the present apparatus.

As shown in FIG. 5, a worm 53 that is meshed with the worm wheel 51 is keyed onto a shaft 54 which is rotatably supported by a bearing mounted on the bracket 52. A pulley 55 is keyed onto an end portion of the shaft 54 which projects from the bracket 52. A small gear 56 (FIG. 6) meshed with the large gear 5 is keyed onto a shaft 57 which is rotatably supported by a bearing fitted into the tool mounting frame 2, and the shaft 57 has a pulley 58 at its one end. The pulley 55 (FIG. 5) is rotated by the rotation of the pulley 58 via a belt which is passed therebetween. A cam-follower mounting plate 62 is fitted onto the external-thread portion 46*b* in such a manner that its position is adjustable along the axis of the operating rod 46 and it is rotatable with respect thereto Immediately below the operating rod (as viewed perpendicular to the surface of the sheet of FIG. 3), the cam-follower mounting plate 62 provides support for a cam follower 60 by means of a small shaft which extend at right angles to the operating rod 46. The cam-follower mounting plate 62 is guided along guide rods 63 whose opposite ends are supported by the unit support 41 and the bracket 52 and which extend parallel to the operating rod 46 on opposite sides thereof.

On the side of the tool operating support 42 which opposes the cam follower 60, a cam follower 65 is rotatably supported by a small shaft 64 which extends at right angles to the operating rod 46. The cam followers 60 and 65 are rotated under the control of a cam which is driven by the rotation of the large gear 4. More specifically, at a position defined between the tool operating support 42 and the bracket 52, that is, between the cam followers 60 and 65, a bracket 66 is fastened to the surface of the tool mounting frame 2 concentrically with one of windows 2*a* formed therein A gear shaft 67 is rotatably supported by a bearing at right angles to the surface of the tool mounting frame 2 on which the bracket 66 is fastened, that is, perpendicular to the direction in which the tool operating support 42 slides. A small gear 68, which is keyed onto one end portion of the gear shaft 67, is meshed with the large gear 4. A disk cam 69, which is keyed onto the other end of the gear shaft 67, is kept in contact with the cam follower 65, while a disk cam 70, which is concentrically fastened to a boss portion of the disk cam 69, is kept in contact with the cam follower 60. Each of the cam-follower mounting plate 62 and the tool operating support 42 is urged by the action of a corresponding spring (not shown) so that the disk cams 69 and 70 can always be kept in contact with the cam followers 65 and 60, respectively.

Figure 7:
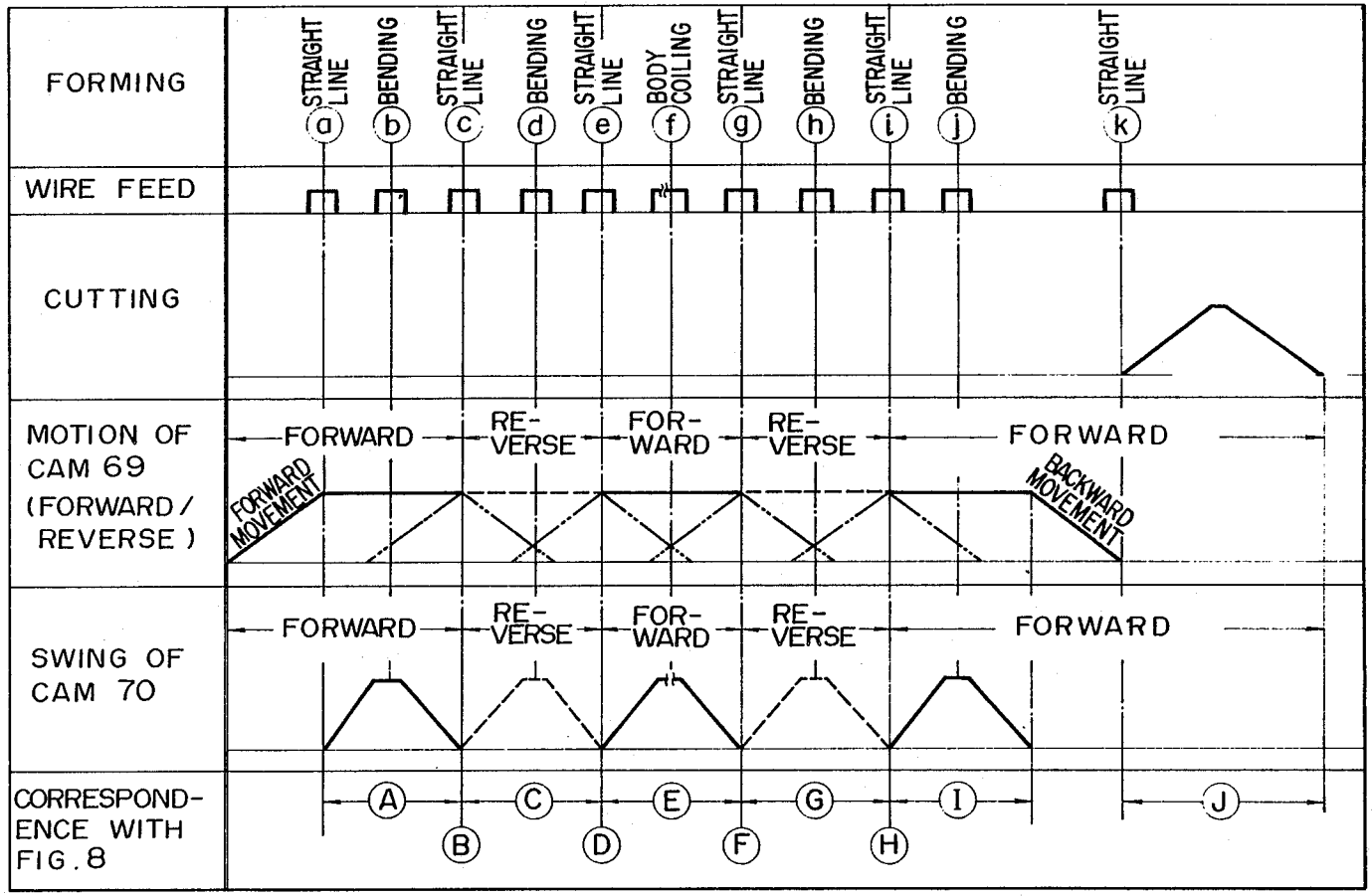
Figures 8, 9A, 9B:
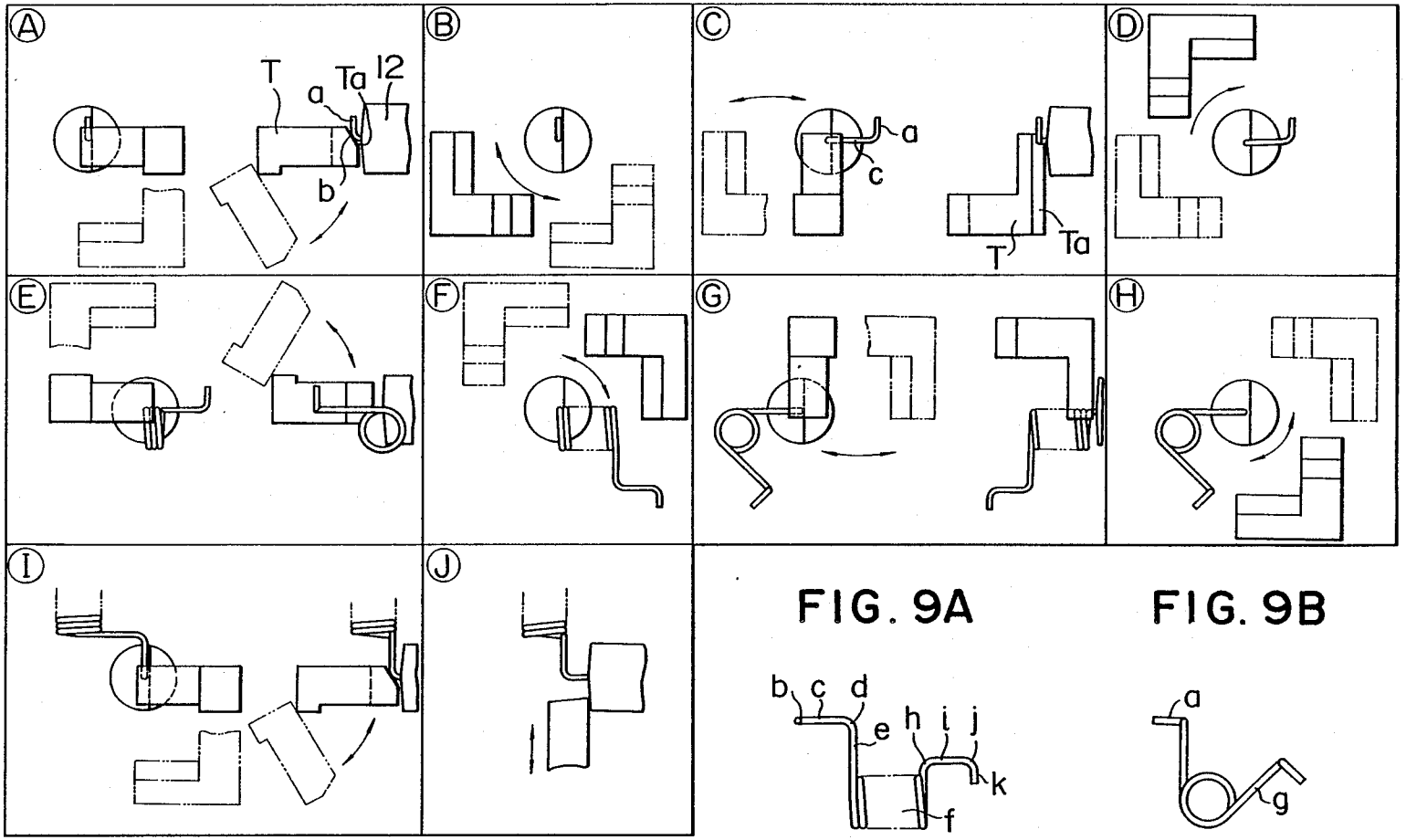
FIG. 8 is an illustration of a process for forming a spring.
FIGS. 9A and 9B are front and side elevations illustrating a torsion coil spring formed by the process shown in FIG. 8.

A method of producing a torsion coil spring, such as that shown in FIGS. 9A and 9B, by means of the above-described embodiment will be described below with reference to FIG. 7 which is a control chart as well as FIG. 8 which illustrates each step of the production process.

First, the wire feed roller 14 is caused to rotate by the drive of the servo motor 11 which receives a command supplied from a numerical control device (not shown), thereby feeding a straight portion (a) of a hooked end of a wire. Then, the large gear 4 is caused to rotate by the drive of the servo motor 7 which receives a command supplied from the numerical control device, thereby causing the small gear 68 to rotate. Thus, the disk cams 69 and 70 are caused to rotate through the gear shaft 67. As shown in FIG. 7, the cam surface of the disk cam 69 initially acts upon that of the cam follower 65 to cause the tool operating support 42 to move forwardly toward the quill 12. This forward movement of the tool operating support 42 causes the operating cylinder 45 together with the forming tool T to move forwardly from preliminary position to standby position. Subsequently, the disk cam 70 acts upon the cam follower 60 to cause backward movement of the cam-follower mounting plate 62 and hence the operating rod 46. Thus, the linkage member 47 is moved to cause the tool holder 43 to swing about the support shaft 44, thereby causing the forming tool T to swing about the support shaft 44 from its standby position (shown by a phantom line in FIG. 8A) to the position which faces the tip of the quill 12 (FIG. 8A). The forming surface Ta is applied to the wire fed from the quill 12 and form a bent portion (b) of a first hook of a product. When a quarter circle has been formed as the bent portion (b), the action of the disk cam 70 is ceased, and the operating rod 46 is moved forwardly to cause the forming tool T to reverse to the standby position. At this time, the disk cam 69 is still held in a working position since it has a wide working surface.

Then, the large gear 5 is caused to rotate by the drive of the servo motor 9 which receives a command supplied from the numerical control device, and thus the worm wheel 51 is rotated through 90° through the intermediary of the small gear 56, the shaft 57, the pulleys 58 and 55, and the worm 53. This 90° rotation is transmitted through the operating rod 46 to the operating cylinder 45, and the operating cylinder 45 is also rotated through 90°. Thus, the tool holder 43 and the forming tool T are rotated through 90° about the axis of the quill 12 (FIG. 8B). Further, the wire feed roller 14 is rotated by the drive of the servo motor 11 to feed the wire, and thus a straight portion (c) which serves as an engagement portion of the first hook is formed.

When the servo motor 7 is reversed to cause the large gear 4 to rotate in the reverse direction, the disk cam 69 is reversed in such a manner that its working surface is kept in contact with the cam follower 65, so that the tool operating support 42 is held in its forward standby position. In the meantime, the working surface of the disk cam 70 again comes into contact with the cam follower 60 to cause the operating rod 46 to move backwardly through the cam follower 60 and the cam-follower mounting plate 62. Therefore, the forming tool T is rotated and is swung to a position which faces the tip of the quill 12, from the direction which is 90° offset from the previous position, and is applied to the wire fed from the quill 12 to form it into a bent portion (d) (FIG. 8C). When a quarter circle has been formed, the action of the disk cam 70 is ceased, and the operating rod 46 is moved forwardly to cause the forming tool T to swing about the shaft 44 in the reverse direction to its standby position. The disk cam 69 is still held in position such that its working surface is kept in contact with the cam follower 65. When the servo motor 9 is actuated to cause the large gear 5 to rotate, the worm wheel 51 is further rotated through 90° and therefore the operating cylinder 45 and the forming tool T are further rotated through 90° about the axis of the quill 12 (FIG. 8D). In this state, the wire feed roller 14 is rotated by actuating the servo motor 11 to feed the wire, and thus a straight portion (e) which constitute a leg of the first hook is produced.

When the servo motor 7 is forwardly actuated, the small gear 68 and the disk cams 69 and 70 are caused to rotate by the rotation of the large gear 4. More specifically, the disk cam 70 is reversed to cause its working surface to move in the forward direction, while the disk cam 69 is reversed to cause its working surface to move in the forward direction. Thus, the operating rod 46 is caused to move backwardly to swing the forming tool T about the support shaft 44 from the standby position at which it is rotated through 90° to a position which faces the tip of the quill 12. The servo motor 11 is actuated to rotate the wire feed roller 14, feed the wire rod from the quill 12, press it again the forming surface Ta of the forming tool T, and form a coil body (f) (FIG. 8E). If a long coil body is needed, the servo motor 7 is stopped and the disk cams 69 and 70 are held in position such that the working surfaces of the disk cams 69 and 70 are kept in contact with the cam followers 65 and 60, respectively. When a desired number of turns are formed, the action of the disk cam 70 is ceased, and the operating rod 46 is moved forwardly to cause the tool holder 43 and the forming tool T to swing to the standby position. The disk cam 69 is still held in position such that its working surface is kept in contact with the cam follower 65.

The servo motor 9 is actuated to cause the large gear 5 to rotate, thereby causing the worm wheel 51 to further rotate through 90° about the axis of the quill 12. Thus, the operating rod 46, the tool holder 43, and the forming tool T are further rotated through 90° about the axis of the quill 12 (FIG. 8F). During this rotation, the wire feed roller 14 is rotated by the drive of the servo motor 11 to feed the wire from the quill 12, and thus a straight portion (g) of a leg of a second hook is produced.

Then, the servo motor 7 is reversed to cause the large gear 4 to rotate in the reverse direction, thereby rotating the disk cams 69 and 70 in the reverse directions, respectively. The disk cam 70 is reversed to cause its working surface to move in the reverse direction, while the disk cam 69 is reversed to cause its working surface to move in the reverse direction. Thus, the operating rod 46 is moved backwardly to swing the forming tool T to the tip of the quill 12, thereby applying it to the wire fed from the quill 12 and forming a quarter circle (h). The disk cam 70 is made to stop working, and the forming tool T is returned to the standby position (FIG. 8G). Then, the servo motor 9 is actuated to further rotate the worm wheel 51 through 90° about the axis of the quill 12, thereby causing the worm wheel 51 to rotate through 90° about the same axis (FIG. 8H). In this state, the wire feed roller 14 is rotated by actuating the servo motor 11 to feed the wire, and thus a straight portion (i) which serves as an engagement portion of the second hook is produced.

The servo motor 7 is driven in the forward direction to cause the large gear 4 to rotate, thereby causing rotation of the disk cams 69 and 70. The disk cam 69 is still held in position such that its working surface acts upon the cam follower 65. In the meantime, the working surface of the disk cam 70 comes into contact with the cam follower 60 to cause the operating rod 46 to move backwardly, thus causing the forming tool T to swing about the support shaft 44. Thus, the forming tool T is swung to the tip of quill 12 and is applied to the wire fed therefrom, thereby forming it into a ¼ circle (j). Then, the disk cam 70 is rotated to its non-working position (FIG. 8I).

The servo motor 7 is actuated in the forward direction to cause the disk cams 69 and 70 to rotate until their non-working surfaces come into contact with the cam followers 65 and 60, respectively. In this state, the wire feed roller 14 is rotated by actuating the servo motor 11 to feed the wire, and thus a straight portion (k) which constitutes the end portion of the second hook is produced. Although the servo motor 7 continues to operate, the disk cams 69 and 70 are still held in their non-working positions.

In the meantime, the cam follower 25 is pushed toward the center by the motion of the disk cam 24 fixed to the small gear (not shown) meshed with the large gear 4. This movement of the sliding member 22 causes the cutting tool CT to move to the tip of the quill 12, thereby cutting the wire.(FIG. 8J). When the disk cam 24 is rotated to its non-working position and is returned to its initial position, the disk cams 69 and 70 return to their respective initial positions. The forming tool T is moved backwardly to the preliminary position.

A second preferred embodiment of the present invention will be described below with reference to FIGS. 10 through 14. In the second embodiment, the same reference numerals are used to denote the same elements used in the first embodiment, and the description thereof is omitted.

Figure 10:
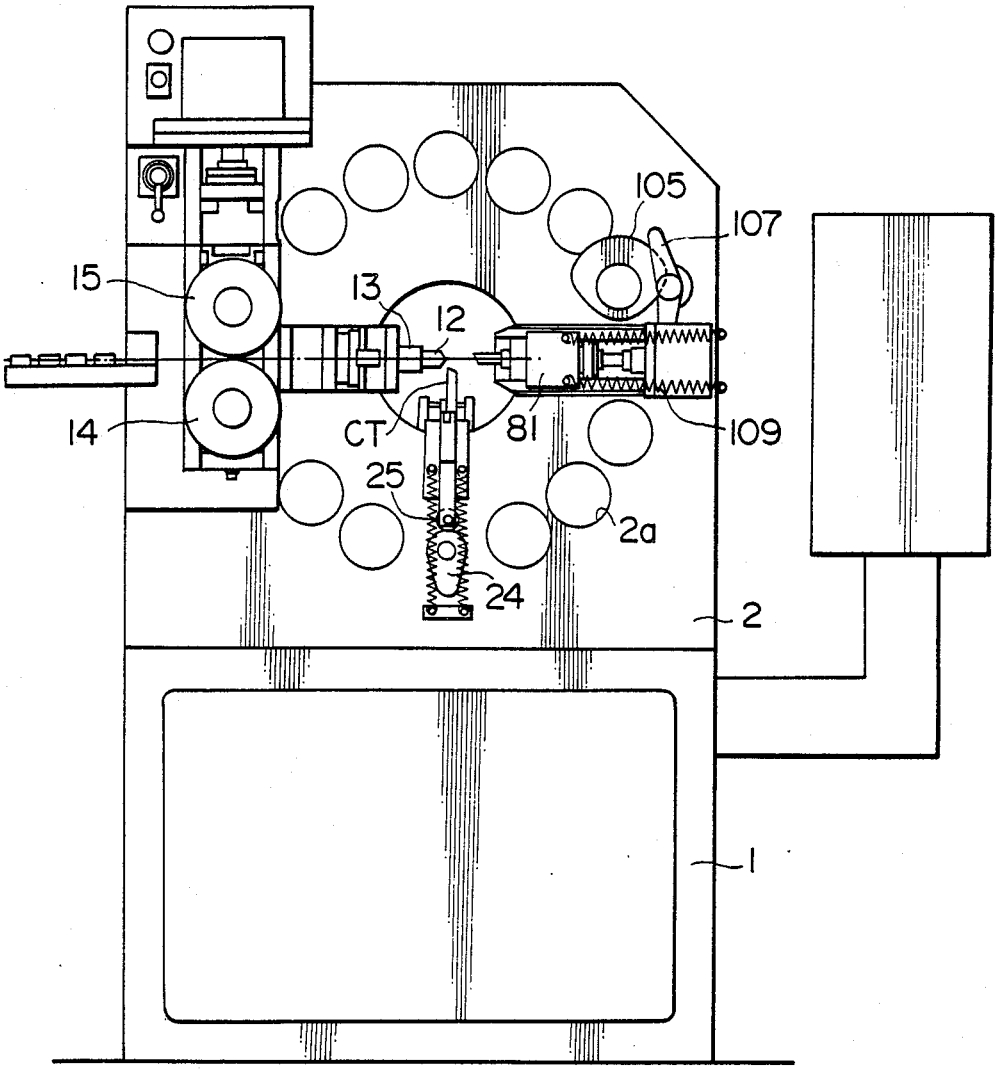
FIG. 10 is a diagrammatic front elevation of a coil forming apparatus according to a second preferred embodiment of the present invention.
Figure 11:
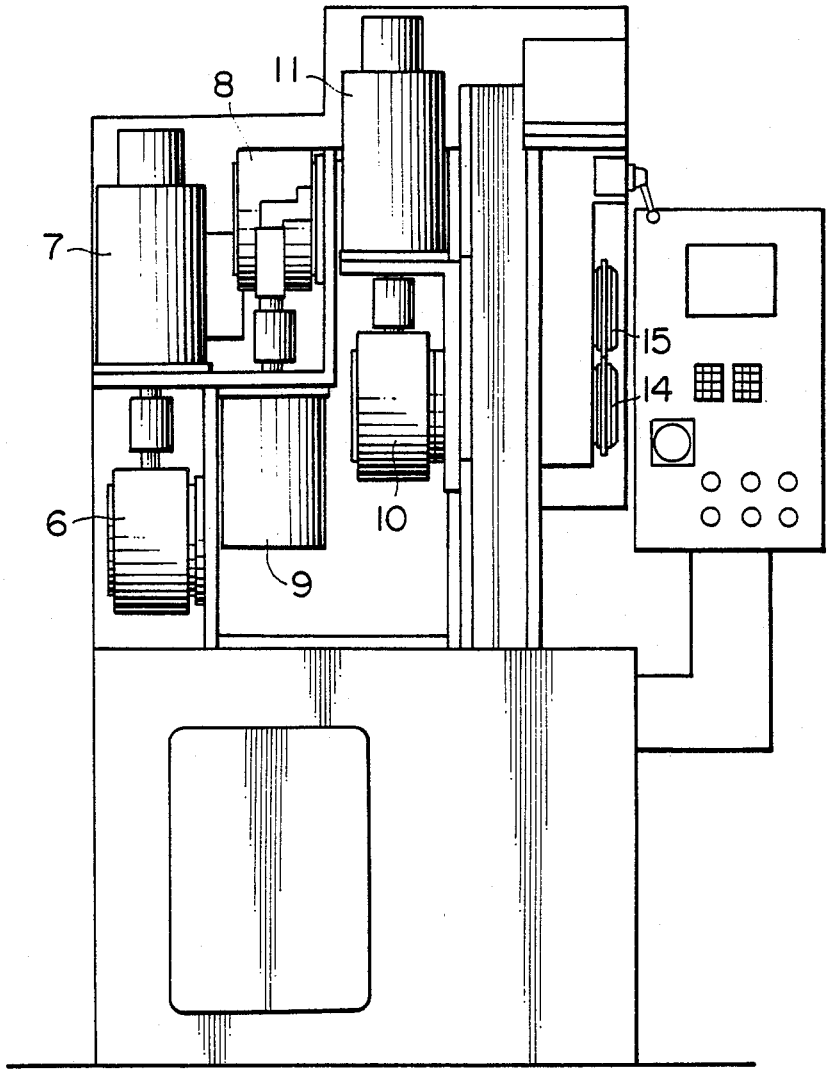
FIG. 11 is a diagrammatic side elevation, partially in cross section, of the apparatus shown in FIG. 1.

In FIGS. 10 and 11, a forming unit 81 is located at a position opposite to that of the forming unit 40 used in the first embodiment on the tool mounting frame 2. The pressure roller 15 is pressed against the wire feed roller 14 through a piston rod by the action of an associated air cylinder If the wire has a small diameter, the pressure roller 15 is pressed against it by the force of a spring held under compression between this roller and the piston rod. If the diameter of the wire is large, the pressure roller 15 is pressed against it directly by the action of the air cylinder, irrespective of the force of the spring.

Figure 12:
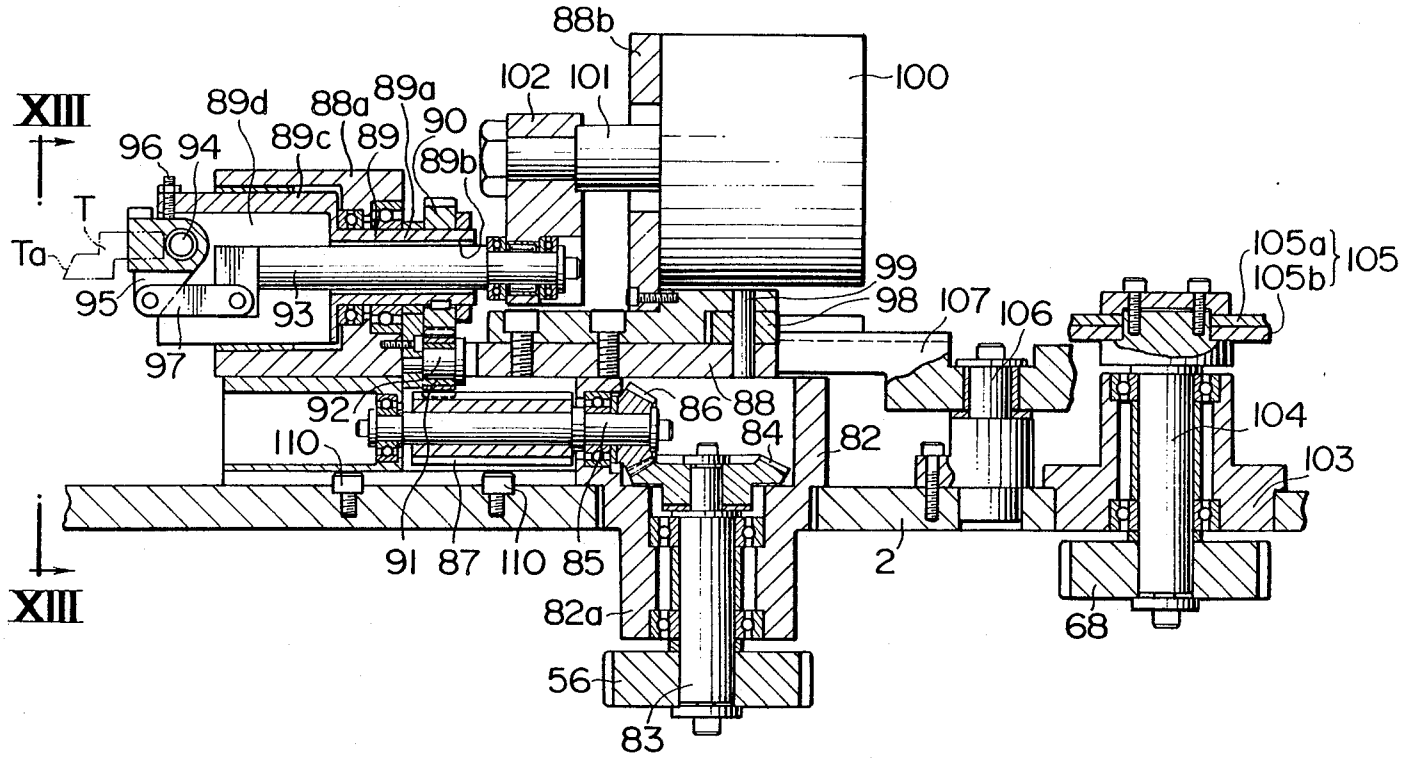
FIG. 12 is a diagrammatic vertical section of a forming tool unit incorporated in the second embodiment.
Figure 13:
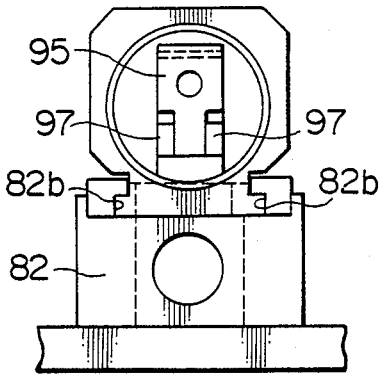
FIG. 13 is a view taken along the line XIII—XIII of FIG. 12.

The forming unit 81, although its arrangement is greatly modified, is mounted on the tool mounting frame 2 similarly to that of the first embodiment. As shown in FIGS. 12 and 13, a gear shaft 83 is rotatably supported by a bearing portion 82*a* which is incorporated in a unit support 82, the longitudinal axis of the bearing portion 82*a* being perpendicular to a mounting surface of the tool mounting frame 2 on which the unit support 82 is mounted. The small gear 56 which is meshed with the same large gear 5 as that of the first embodiment is keyed onto the projecting end portion of the gear shaft 83, while a bevel gear 84 is keyed onto the other end of the gear shaft 83. A gear shaft 85 is rotatably supported by bearings attached to the unit support 82 in such a manner that the longitudinal axis of the gear shaft 85 is perpendicular to that of the gear shaft 83 and parallel to the aforesaid mounting surface. A bevel gear 86 is keyed onto one end portion of the gear shaft 85, and is meshed with the bevel gear 84. A longitudinally extending gear 87 is keyed onto the remaining portion of the gear shaft 85. Guide ways 82*b* which extends parallel to the gear shaft 85 are formed over the top surface of the unit support 82 (FIG. 13). A tool operating support 88 is slidably carried by the guide ways 82*b*. An upper stage 88*a* is formed on the side of the tool operating support 88 nearer to a quill. A stepped operating cylinder 89 is supported for rotation about its axis by a combination of radial ball bearings and slide bearings attached to the upper stage 88*a*. The axis of rotation of the cylinder 89 coincides with the axis parallel to the direction in which the tool operating support 88 is slid, and, when the unit support 82 is mounted on the tool mounting frame 2, the rotation axis is aligned with the center axis of the quill 12. The operating cylinder 88 is further supported by a thrust bearing so as to receive a reaction acting upon a forming tool T. A gear 90 is keyed onto a small diameter portion 89*a* of the stepped operating cylinder 89. A window is opened at a position in the tool operating support 88 that corresponds to the gear 90, and an intermediate gear 91 which is meshed with the gears 90 and 87 is rotatably fitted onto a shaft 92. An axial through-hole 89*b* is formed in the small diameter portion 89*a* of the stepped operating cylinder 89, and a large diameter portion 89*c* of the stepped operating cylinder 89 has a deep groove 89*d* of a width equal to the diameter of the axial through-hole 89*b* with one surface taken in the diametrical direction being left. An operating rod 93 extends through the axial through-hole 89*b* in the small diameter portion 89*a* for rotation about, and reciprocal movement along, its longitudinal axis. A tool holder 95 which is slidably fitted into the deep groove 89*d* is swingably supported by a support shaft 94 in the vicinity of the inlet of the groove 89*d* and at a position nearer to the bottom of the groove 89*d* with respect to the axis of the operating rod 93. The forming tool T is replaceably attached to the tool holder 95 on the axis extending parallel to the center axis of the operating rod 93 and passing through the support shaft 94 so that the axis of the longitudinal axis of the forming tool T coincides with the axis of the quill 12. The forming tool T has the forming surface Ta which is located on the axis of the operating rod 93. The end of the tool holder 95 opposite to the support shaft 94 along the axis of the operating rod 93 is linked with an L-shaped end of the operating rod 93 by linkage plates 97. At the rear of the tool operating support 88, a cam follower 98 is rotatably supported by a shaft 99 which extends perpendicular to the direction in which the stepped operating cylinder 89 is slid. A bracket 88*b* is located at an intermediate position between the cam follower 98 and the intermediate gear 91, and an air cylinder 100 having an axis parallel to the operating rod 93 is fixed to the bracket 88*b*. A linkage member 102 is fixed to a piston rod 101 of the air cylinder 100, and is axially integrally linked with the rear end of the operating rod 93 through needle and thrust bearings for rotation with respect to each other. A stopper 96 is attached to the large diameter portion 89*c* of the stepped operating cylinder 89. The stopper 96 serves to hold the forming tool T at a predetermined position which faces the tip of the quill 12 when the tool holder 95 is swung by the forward movement of the operating rod 93.

A bearing housing 103 is attached to a mounting hole 2*a* adjacent to the tool mounting frame 2, and a cam shaft 104 is rotatably supported by the bearing housing 103 is such a manner as to extend parallel to the longitudinal axis of the gear shaft 83. The small gear 56 is keyed onto the end portion of the cam shaft 104 on the side on which the small gear 56 is located, and the small gear 56 is meshed with the large gear 4 similarly to that of the first embodiment. Two cam plates 105*a* and 105*b* are secured to the other end of the cam shaft 104 for adjustment of the relative phase therebetween. These two cam plates constitute a composite cam 105.

Figure 14:
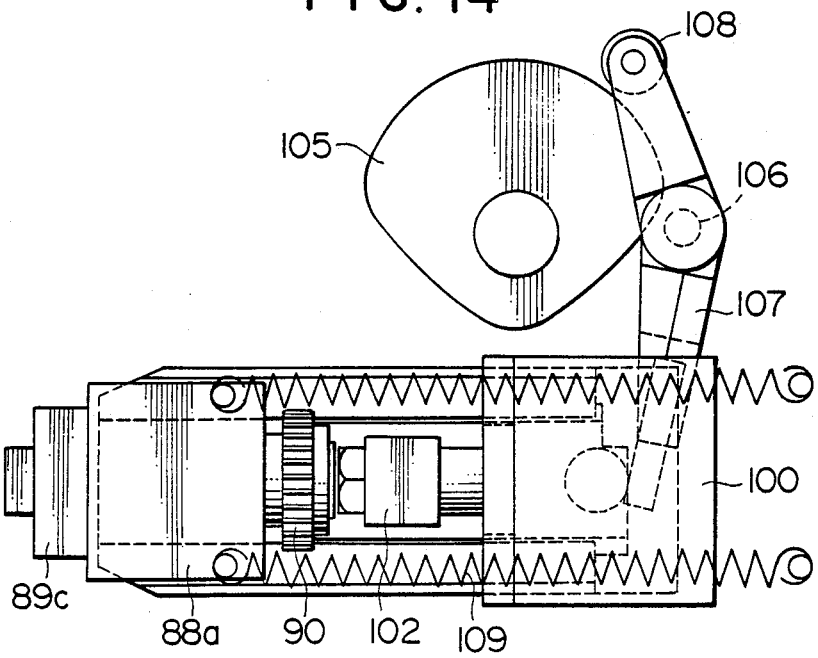
FIG. 14 is a diagrammatic plan view illustrating on an enlarge scale the forming unit shown in FIG. 10.

A lever shaft 106 is attached to the tool mounting frame 2 at an intermediate position thereof between the unit support 82 and the composition cam 105. A lever 107 is pivotably supported by the lever shaft 106 in such a manner that the displacement of the composite cam 105 is transmitted to the cam follower 98. As shown in FIG. 14, springs 109 are held under tension between the tool operating support 88 and the tool mounting frame 2 so as to keep contact between the cam follower 98 and the lever 107 as well as the cam follower 108 and the composite cam 105. The forming unit 81 having the above-described arrangement is radially positioned by dowel pins 110 on the tool amounting frame 2 in such a manner that the tool T faces the quill 12.

Figure 15:
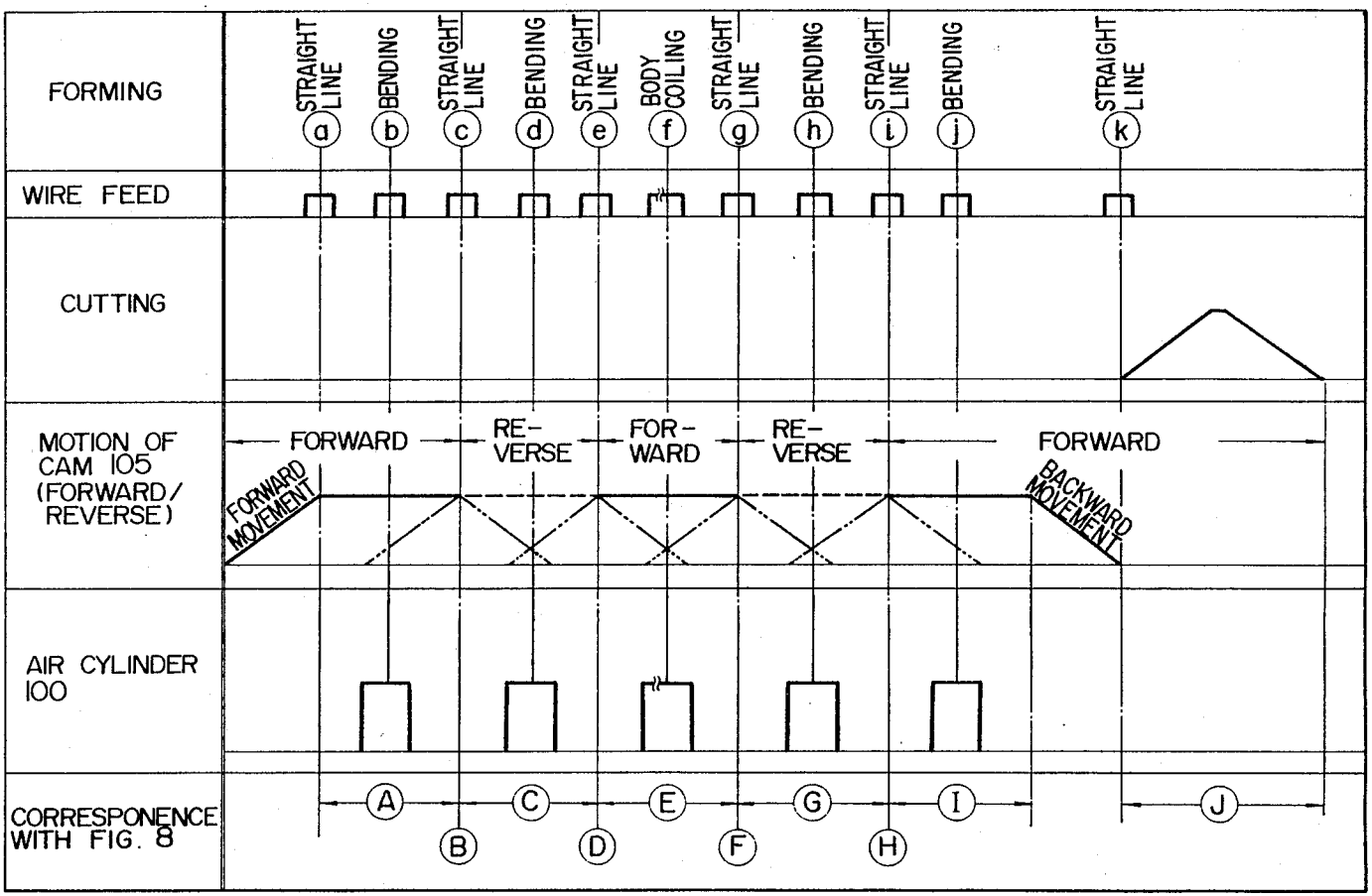
FIG. 15 is a chart illustrating the manner of time sharing relative to the operation of cams, the feed of a wire, air cylinder and so on incorporated in the second embodiments.

A method of producing a torsion coil spring such as that shown in FIGS. 9A and 9B by means of the above-described embodiment will be described below with reference to FIG. 15 which is a control chart as well as FIG. 8 which illustrates each step of the production.

First, the wire feed roller 14 is caused to rotate by the drive of the servo motor 11 which receives a command supplied from a numerical control device (not shown), thereby feeding a straight portion (a) of a hooked end of a wire. Then, the large gear 4 is caused to rotate by the drive of the servo motor 7 which receives a command supplied from the numerical control device, thereby causing the small gear 68 to rotate. Thus, the composite cam 105 of the cam shaft 104 is caused to rotate. The cam surface of the composite cam 105 causes the lever 107 to rotate, thereby causing the tool operating support 88 to move forwardly toward the quill 12 through the cam follower 98. This forward movement causes the operating cylinder 89 together with the forming tool T to move from preliminary position to standby position When the cam shaft 104 is rotated through a predetermined angle in accordance with a command indicative of rotation, compressed air is fed to the rear chamber in the air cylinder 100 to cause the piston rod 101 and the linkage member 102 to move forwardly, thereby causing the operating rod 93 to move forwardly toward the quill 12. Therefore, the linkage plates 97 causes the tool holder 95 to swing about the support shaft 94, thereby causing the forming tool T to swing about the support shaft 94 from its standby position (shown by the phantom line in FIG. 8A) to a position which faces the tip of the quill 12 (FIG. 8A). Thus, the forming surface Ta is applied to the wire fed from the quill 12 and forms it into the bent portion (b) of the first hook. After a ¼ circle has been formed, compressed air in the air cylinder 100 is moved from the rear chamber to the front chamber to cause the piston rod 101 and the linkage member 102 to move backwardly, thereby causing the operating rod 93 to move backwardly. Thus, the forming tool T is reversed to its standby position. During this time, since the composite cam 105 has a wide working surface, the cam 105 is still maintained in a working position Then, the large gear 5 is caused to rotate by the drive of the servo motor 9 which receives a command supplied from the numerical control device, and thus the wheel 90 is rotated through 90° through the intermediary of the small gear 56, the gear shaft 83, the bevel gears 84 and 86, and the gear shaft 85, and the gears 87 and 91. This 90° rotation is transmitted through the operating rod 89 to the operating cylinder 93, and the operating cylinder 93 is also rotated through 90°. Thus, the tool holder 95 and the forming tool T are rotated through 90° about the axis of the quill 12 (FIG. 8B). Further, the wire feed roller 14 is rotated by the derive of the servo motor 11 to feed the wire, and thus a straight portion (c) which serves as an engagement portion of the first hook is formed.

When the servo motor 7 is reversed to cause the large gear 4 to rotate in the reverse direction, the composite cam 105 is reversed in such a manner that its working surface keeps the lever 107 is contact with the cam follower 65, so that the tool operating support 88 is held in its forward standby position. When the cam shaft 104 reaches a predetermined angular position, the compressed air in the air cylinder 100 is moved from the front chamber to the rear chamber to cause the piston rod 101, the linkage member 102 and the operating rod 93 to move forwardly. Therefore, the tool holder 95 and the forming tool T are swung and are moved to a position which faces the tip of the quill 12 from the direction which is offset by 90° from the previous position, and is applied to the wire fed from the quill 12 to form it into a bent portion (d) (FIG. 8C). When a quarter circle has been formed, the pressure in the air cylinder 100 is moved from the rear chamber to the front chamber to cause the operating rod 93 to move backwardly, thereby causing the forming tool T to swing about the shaft 94 in the reverse direction to its standby position. The composite cam 69 is still held in position such that its working surface is kept in contact with the corresponding element. When the servo motor 9 is actuated to cause the large gear 5 to rotate, the wheel 90 is further rotated through 90° through the intermediary of the small gear 56, the bevel gears 84 and 86, and the gears 87 and 91. Therefore, the stepped operating cylinder 89, the operating cylinder 93 and the forming tool T are further rotated through 90° about the axis of the quill 12 (FIG. 8D). In this state, the wire feed roller 14 is rotated by actuating the servo motor 11 to feed the wire, and the thus the straight portion (e) which constitutes a leg of the first hook is produced.

When the servo motor 7 is forwardly actuated, the small gear 68 and the composite cam 105 are caused to rotate by the rotation of the large gear 4. More specifically, the composite cam 105 is reversed to cause its working surface to move in the forward direction. When the composite cam 105 reaches a predetermined angular position of the cam shaft 104, the compressed air in the air cylinder 100 is moved from the front chamber to the rear chamber to cause the operating rod 93 to move forwardly. Thus, the forming tool T is swung about the support shaft 94 from the standby position at which it is rotated through 90°, to a position which faces the tip of the quill 12. The servo motor 11 is actuated to rotate the wire feed roller 14, feed the wire from the quill 12, press it again the forming surface Ta of the forming tool T, and form the coil body (f) (FIG. 8E). If a long coil body is needed, the servo motor 7 is stopped and the composite cam 105 is held in position such that the working surface of the composite cam 105 is kept in contact with the corresponding element. When a desired number of turns are formed, the compressed air in the air cylinder 100 is moved from the rear chamber to the front chamber to cause the operating rod 93 to move backwardly, thereby causing the tool holder 95 and the forming tool T to swing to the standby position. The composite cam 105 is still held in position such that its working surface is kept in contact with the corresponding element.

The servo motor 9 is actuated to cause the large gear 5 to rotate, thereby causing the stepped operating cylinder 89 to further rotate through 90° about the axis of the quill 12. Thus, the operating rod 93, the tool holder 95, and the forming tool T are further rotated through 90° about the axis of the quill 12 (FIG. 8F). During this rotation, the wire feed roller 14 is rotated by the drive of the servo motor 11 to feed the wire from the quill 12, and thus the straight portion (g) of the leg of the second hook is produced Then, the servo motor 7 is reversed to cause the large gear 4 to rotate in the reverse direction, thereby rotating the composite cam 105 in the reverse direction. When the composite cam 105 reaches a predetermined angular position of the cam shaft 104, the pressure in the air cylinder 100 is moved from the front chamber to the rear chamber to cause the operating rod 93 to move forwardly, thereby causing the forming tool T to swing to a position which faces the tip of the quill 12. Thus, the forming tool T is applied to the wire fed from the quill 12 to form the quarter circle (h), and the compressed air in the air cylinder 100 is moved from the rear chamber to the front chamber to cause the forming tool T to swing to the standby position (FIG. 8G). Then, the servo motor 9 is actuated to further rotate the stepped operating cylinder 89 through 90° about the axis of the quill 12 through the intermediary of a gear train including the large gear 5 and the small gear 56, thereby causing the stepped operating cylinder 89 to rotate through 90° about the same axis (FIG. 8H). In this state, the wire feed roller 14 is rotated by actuating the servo motor 11 to feed the wire, and thus the straight portion (i) which serves as the engagement portion of the second hook is produced The servo motor 7 is driven in the forward direction to cause the large gear 4 to rotate, thereby causing rotation of the composite cam 105. The composite cam 105 is still held in position such that its working surface acts upon the corresponding element When the composite cam 105 reaches a predetermined position of the cam shaft 104, the compressed air in the air cylinder 100 is moved from the front chamber to the rear chamber to cause the operating rod 93 to move forwardly, thereby causing the forming tool T to swing to a position which faces the tip of the quill 12. Thus, the forming tool T is applied to the wire fed from the quill 12, thereby forming it into the ¼ circle (j). Then, the compressed air in the air cylinder 100 is moved from the rear chamber to the front chamber to cause the operating rod 93 to move backwardly, thereby causing the forming tool T to swing to its standby position (FIG. 8I).

The servo motor 7 is actuated in the forward direction to cause the composite cam 105 to rotate until its non-working surface comes into contact with the corresponding element. In this state, the wire feed roller 14 is rotated by actuating the servo motor 11 to feed the wire, and thus the straight portion (k) which constitutes the end portion of the second hook is produced. Although the servo motor 7 continues to operate, the composite cam 105 is still held in its non-working position.

In the meantime, the cam follower 25 is pushed toward the radial center by the motion of the disk cam 24 fixed to the small gear [not shown) meshed with the large gear 4 This movement of the sliding member 22 causes the cutting tool CT to move to a position which faces the tip of the quill 12, thereby cutting the wire (FIG. 8J). When the disk cam 24 is rotated to its non-working position and is returned to its initial position, the composite cam 105 returns to its initial position. The forming tool T is moved backwardly to the preliminary position.

Figure 16:
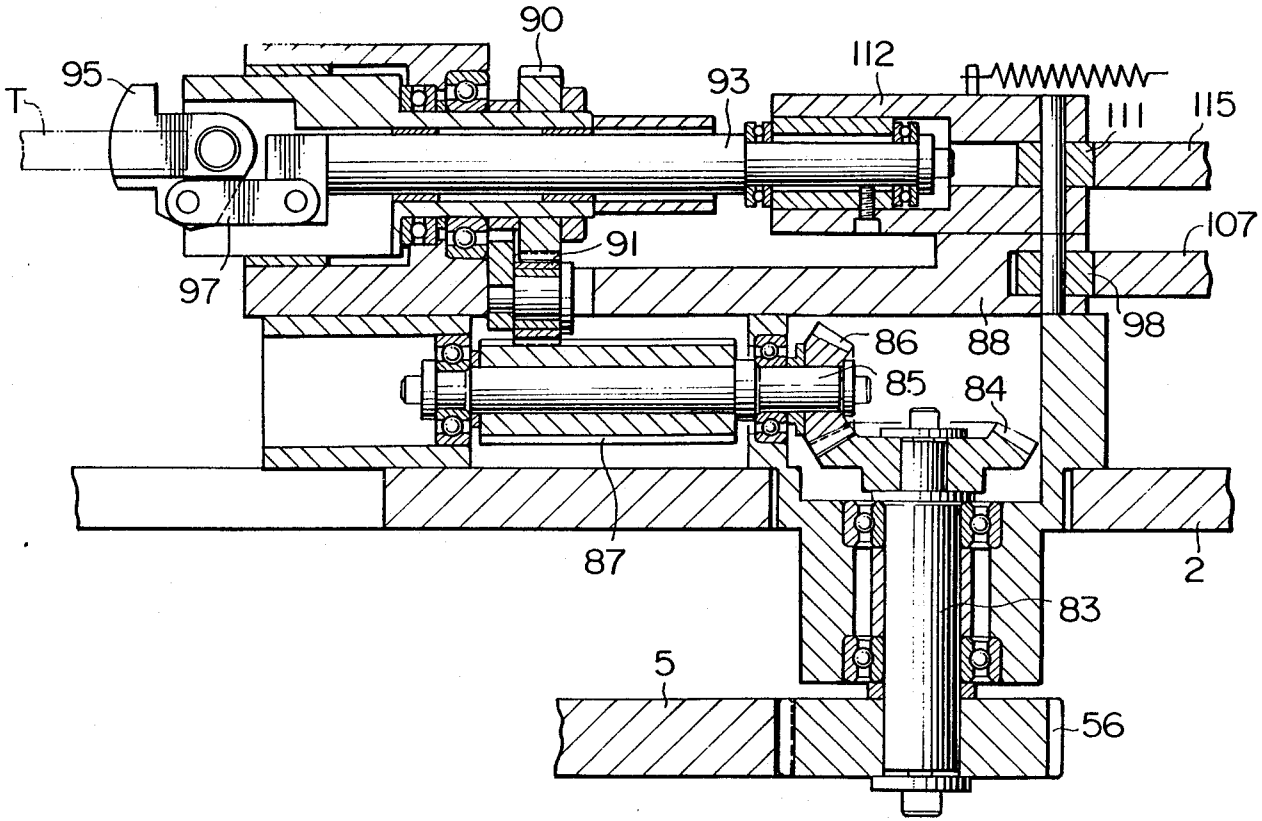
FIG. 16 is a diagrammatic vertical section of a forming unit incorporated in a third embodiment of the spring forming apparatus in accordance with the present invention.
Figure 17:
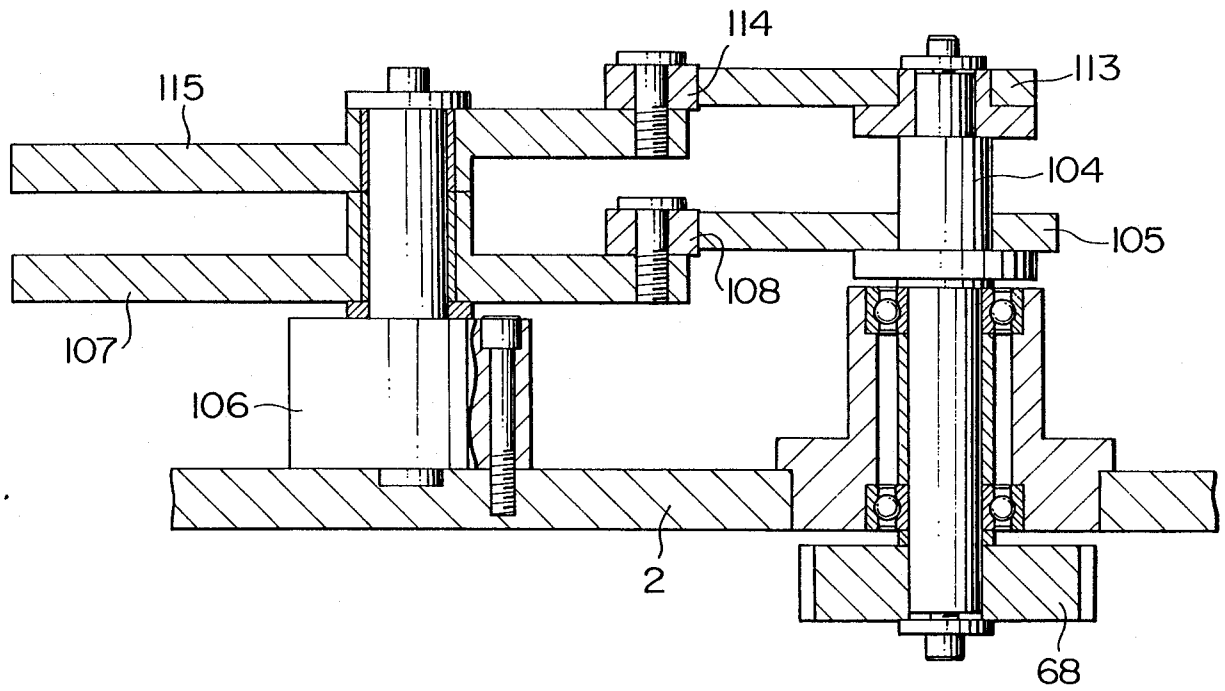
FIG. 17 is a diagrammatic cross section illustrating cams and a lever mechanism incorporated in the third embodiment.

FIGS. 16 and 17 illustrate a third preferred embodiment in which the forming unit 81 is actuated by a cam drive, instead of by the air cylinder 100 used in the second embodiment. In FIGS. 16 and 17, the same reference numerals are used to denote the same elements used in the above-described embodiments, and the following description is made with respect to modified portions only.

A roller holder 112 (FIG. 16) which rotatably supports a cam follower 111 is connected to the rear end of the operating rod 93, and the roller holder 112 and the operating rod 93 are capable of being integrally rotated about a longitudinal axis thereof. The roller holder 112 is slidably carried on the tool operating support 88. The cam shaft 104 (FIG. 17) has the composite cam 105 as well as a similar composite cam 113. The composite cam 113 is attached to an upper portion of the cam shaft 104 with a predetermined phase difference between these cams. Further, a lever 115 is pivoted on the lever shaft 106. The lever 115, on one end thereof, is kept in contact with the cam follower 111 of the roller holder 112 and, on the other end, rotatably supports the cam follower 114 which is kept in contact with the composite cam 113. Although the operating rod 93 in the second embodiment is moved forwardly and backwardly by the action of the air cylinder 100, this movement is caused by the motion of the composite cam 113 in the third embodiment. Accordingly, the action of the cam followers described in the first embodiment is attained utilizing the forward and backward rotation of the cam shaft 104.

As is apparent from the foregoing detailed description of the embodiments, in accordance with the present invention, a single forming tool is capable of being swung about the quill axis as well as between a forming position which faces the tip of the quill and a standby position. Accordingly, since a single tool can be used as various kinds of tool, a variety of complicated bending is enabled, and hence modifications in the form of torsion coil springs are easy to accomplish.

A fourth preferred embodiment of the present invention will be described below with reference to FIGS. 18 through 28. In the fourth embodiment, the same reference numerals are used to denote the same element used in each of the above-described embodiments.

Figure 18:
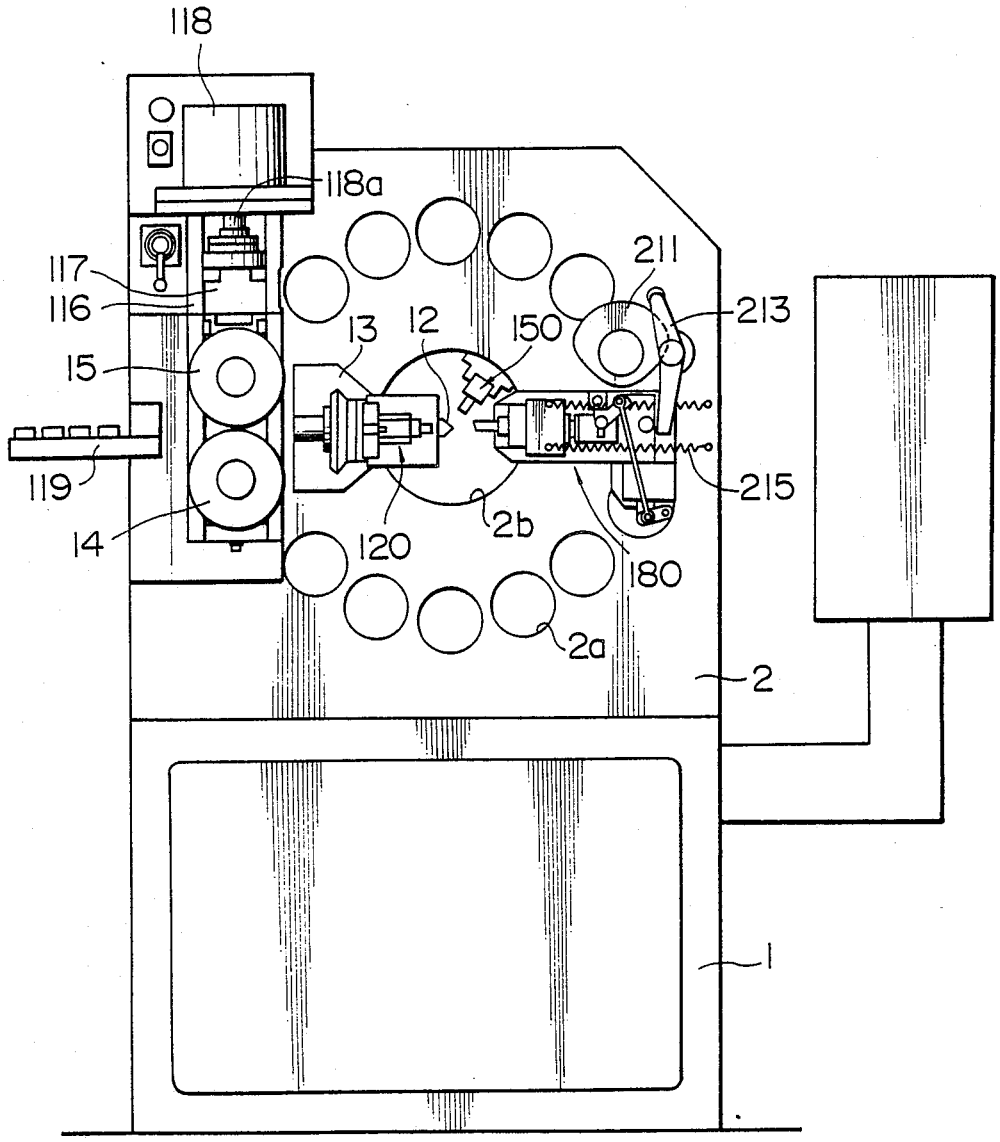
FIG. 18 is a diagrammatic front elevation of a fourth embodiment of a spring forming apparatus in accordance with the present invention.
Figure 19:
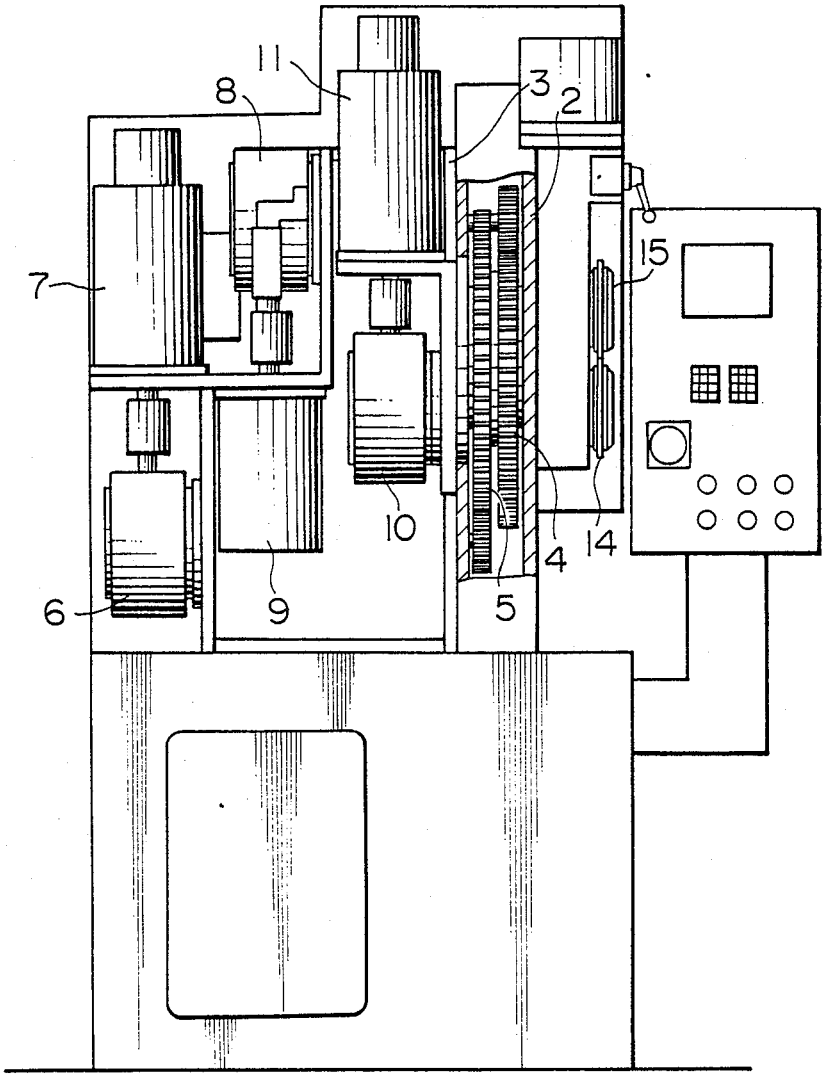
FIG. 19 is a diagrammatic side elevation, partially in cross section, of the apparatus shown in FIG. 18.

In FIGS. 18 and 19, the base 1 carries the tool mounting frame 2 and the box 3 behind it. The large gears 4 and 5 are concentrically supported by the tool mounting frame 2 so as to rotate about their respective axes separately from each other The large gear 4 serves to rotate cams which cause swinging motion of a forming tool, while the large gear 5 serves to cause rotation of the forming tool. The box 3 includes the reduction gear 6 which is driven to rotate the large gear 4, the servo motor 7 for driving the reduction gear 6, the reduction gear 8 which is driven to rotate the large gear 5, the servo motor 9 for driving the reduction gear 6, the reduction gear 10 which is driven to rotate the wire feed roller 14, and the servo motor 11 for driving the reduction gear 10. These servo motors are controlled by a numerical control device (not shown).

The quill 12 through which a wire is guided along a longitudinal bore is mounted on the mounting support 13 in such manner that the longitudinal axis of the quill 12 extends horizontally toward the center of the tool mounting frame 2. The tip of the quill 12 is located on the concentric axis of the large gears 4 and 5. At the rear of the quill 12, the wire feed roller 14 and the pressure roller 15 are disposed at positions above and below the center axis of the quill 12, respectively. The wire feed roller 14 has a circumferential surface around which a groove is formed, and is supported by a mounting support 116 for rotation about its axis. The wire feed roller 14 is caused to rotate by the servo motor 11 through the reduction gear 10. The pressure roller 15 is rotatably supported on a block 117 which in turn is vertically movably supported on the mounting support 116. The pressure roller 15 is pressed against the wire feed roller 14 by the force of a spring (not shown) which is held in compression between the pressure roller 15 and a spring receiver, as well as by the action of a piston rod 118*a* of an air cylinder 118. The wire is fed from a hoop (not shown), corrected by a corrector 119, and fed from the quill 12 by being clamped between the upper and lower rollers.

Figure 20:
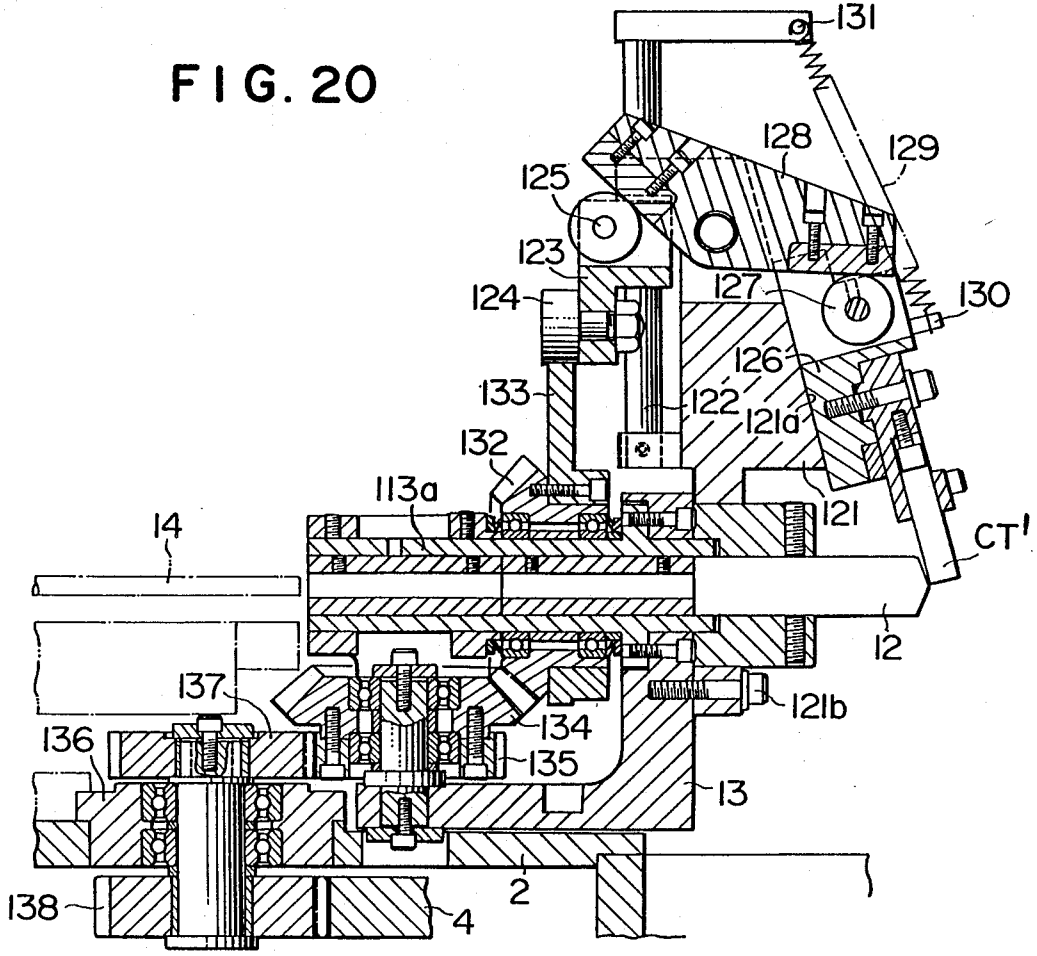
FIG. 20 is a diagrammatic vertical section of a central unit incorporated in the fourth embodiment.
Figure 21:
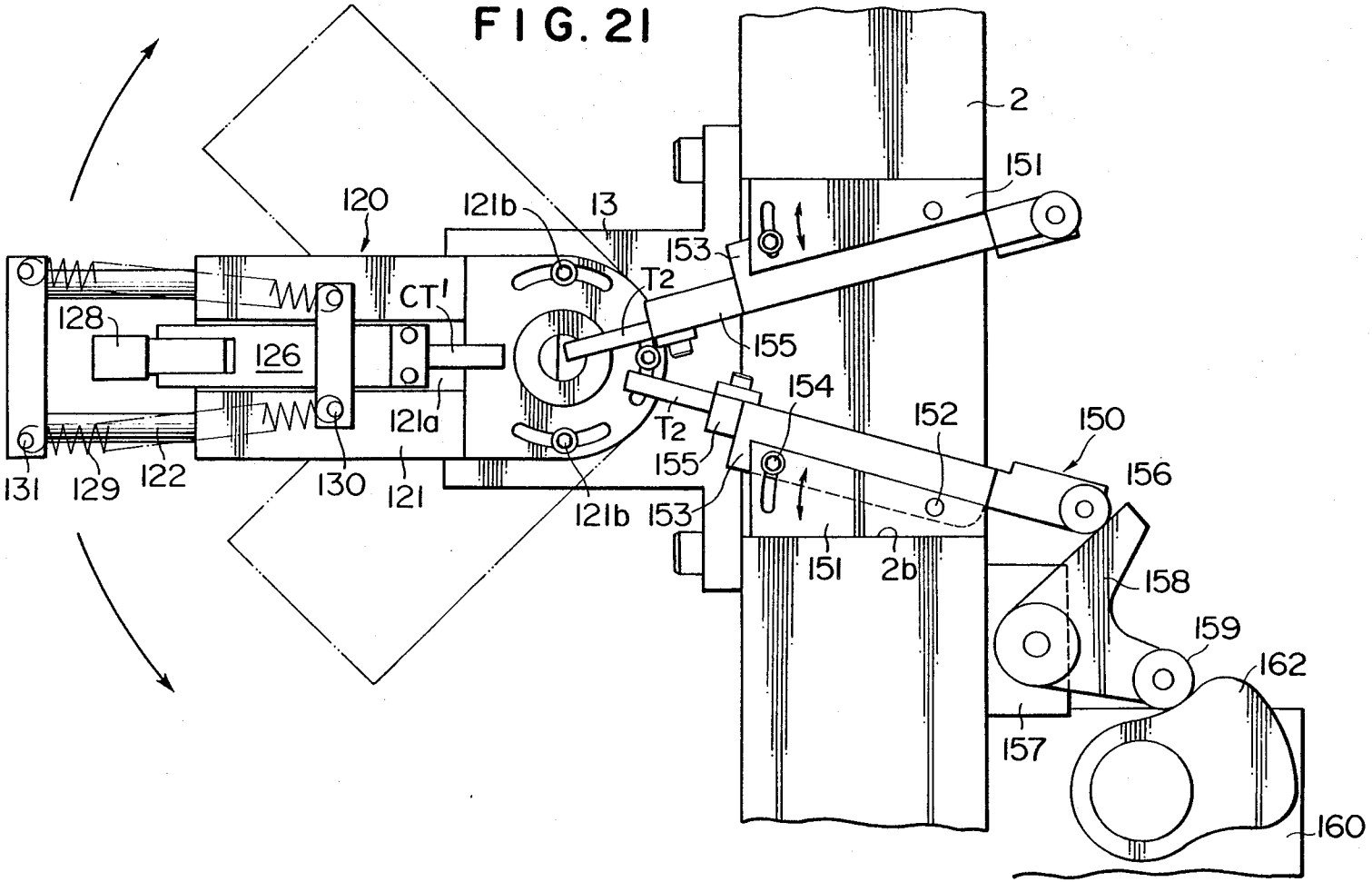
FIG. 21 is an illustration showing the positional relationship between the central unit and rear unit incorporated in the fourth embodiment.

Referring to FIGS. 20 and 21, a cutting/bending unit 120 is constructed as a central unit, and a support 121 is secured to the mounting support 13 by a bolt 121*b*. In this embodiment, the angle of rotation of the support 121 can be adjusted concentrically with the axis of the quill 12 within a range of ±60° with respect to a horizontal line perpendicular to a mounting surface of the tool mounting frame 2 on which the mounting support 13 is mounted. On the side of the support 121 nearer to the wire feed roller 14, two guide rods 122 are disposed at right angles to the axis of the quill 12. A T-shaped guide way 121*a* is cut on the side of the support 121 nearer to the tip of the quill 12. In this example, the guide way 121*a* is inclined by an angle of 15° with respect to the axis of the guide rods 122 as viewed in FIG. 20. A cam-follower holding member 123 is slidably fitted onto each of the guide rods 122. The cam-follower holding member 123 is provided with a cam follower 124 which is rotatably supported by a shaft parallel to the quill axis. At a position above the cam follower 124, a roller follower 125 is rotatably supported by a shaft extending perpendicular to the axis of the quill 12 and the guide rods 122. A tool holder 126 is slidably fitted into the inclined T-shaped guide way 121*a* formed in the support 121. A cutting/bending tool CT′ is replaceably secured to the lower end portion of the tool holder 126 as viewed in FIG. 20. During downward movement, the cutting/bending tool CT′ moves to a position which faces the tip of the quill 12, and cuts the wire in cooperation with the tip of the quill 12. The tool CT′ further moves downwardly to bend a rear end portion of the thus-cut spring. At the central portion of the top end of the tool holder 126, a roller 127 is rotatably supported by a shaft parallel to the axis of the roller follower 125. At the top of the support 121, a lever 128 is supported pivotally at its substantial center by a shaft which extends substantially parallel to the pivot shaft of the roller follower 125. The opposite ends of the lever 128 are kept in contact with the roller follower 125 and the roller 127. Two springs 129 are respectively held in tension between pins 130 fixed to the tool holder 126 and pins 131 fixed to a mounting plate which connects the top ends of the guide rods 122. The springs 129 always act to attract the tool holder 126 upwardly and keep the roller 127 is contact with the lever 128. A boss portion 113*a* is formed on the mounting support 13 concentrically with the axis of the quill 12, and a bevel gear 132 is journaled in a bearing attached to the boss portion 113*a* for concentrical rotation with respect to the axis of the quill 12, thereby causing the tool holder 126 to move forwardly and backwardly. A disk cam 133 is fastened to the boss portion of the bevel gear 132. A bevel gear 134 is fixed to one end of a shaft which is journaled in a bearing attached to the mounting support 13 at right angles to the quill axis, and rotates the bevel gear 132 in a meshed relationship. A gear 135 is fixed to the bevel gear 134, integrally and concentrically. The gear 135 in turn is meshed with a gear 137 which is fixed to the top end of a shaft journaled in a bearing attached to a bracket 136 which is secured to the tool mounting frame 2 at right angles. A gear 138 is fixed to the other end of this shaft which extends into the interior of the tool mounting frame 2. The gear 138 is meshed with the large gear 4, and the rotation of the large gear 4 is transmitted to the disk cam 133 through the above-described gear train so that the cutting/bending tool CT′ is moved toward and away from the wire at a predetermined timing by the motion of the disk cam 133.

Figure 22:
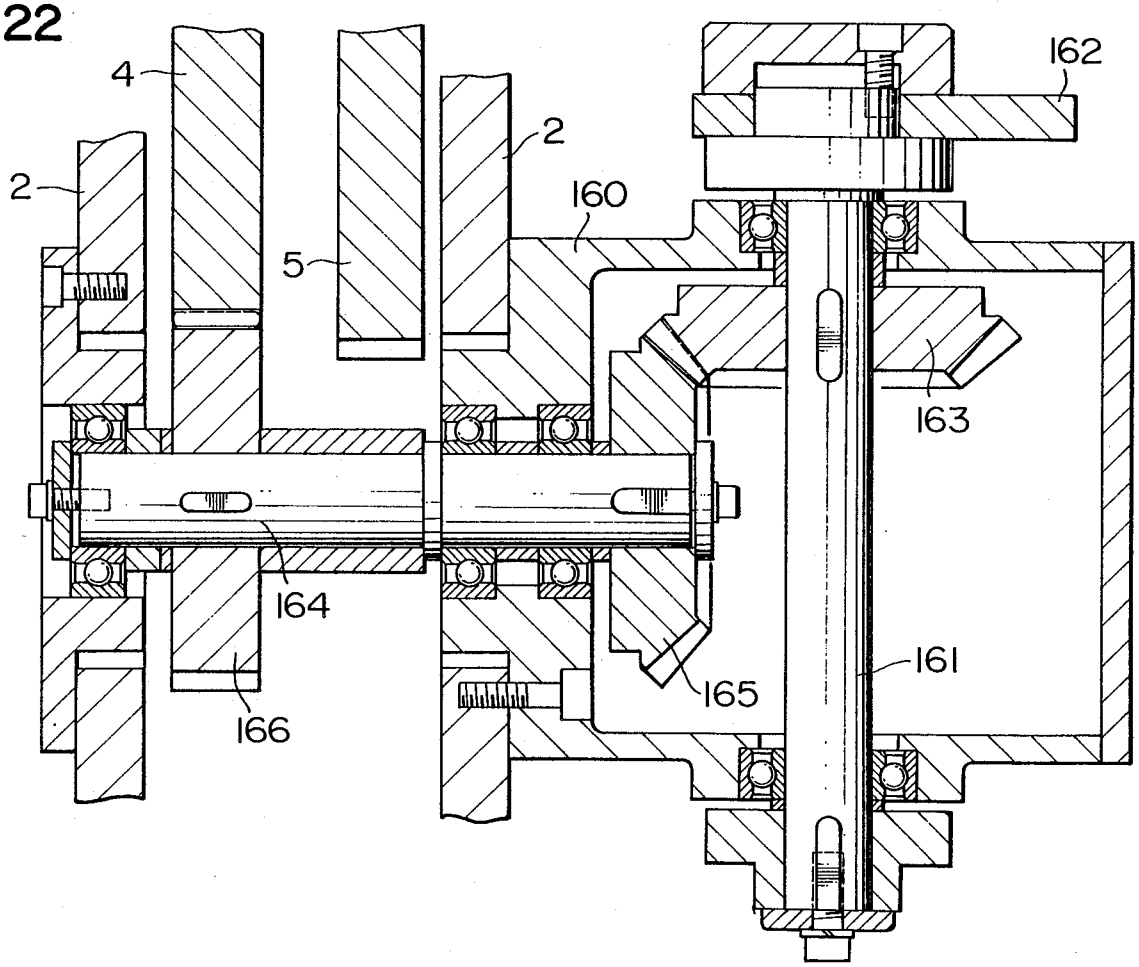
Fig. 22 is a diagrammatic cross section of a cam driving section for one of the rear unit shown in FIG. 21.

As shown in FIGS. 21 and 22, a mandrel unit 150 is constituted as a rear unit, and at least one mandrel unit 150 having the same arrangement is disposed at a predetermined position on the inner circumference of a centeral through-hole 2*b* in the tool mounting frame 2 in such a way that a mandrel tool T2 of the mandrel unit 150 is moved toward and away from the axis of the quill 12 along a predetermined course extending from the rear side of the tool mounting frame 2. Each mounting support 151 is fixed to the inner circumference of the central through-hole 2*b*, and an angle adjustment support 153 is supported swingably at its rear end by a shaft 152 parallel to the quill axis. The angle adjustment support 153 is secured to an arcuated slot by a tightening bolt 154 so that the angle with respect to the quill axis can be adjusted. A guide way which extends toward the quill axis is cut in the angle adjustment support 153. A mandrel tool T2 is attached to the front end of the angle adjustment support 153, and a holder 155 is slidably fitted onto the other end thereof. The holder 155 has a roller follower 156 which is rotatably supported by a shaft parallel to the quill axis. A bracket 157 is fixed to the rear side of the tool mounting frame 2, and an L-shaped lever 158 is secured to the bracket 157 for pivotal movement about a shaft parallel to the axis of the quill 12. The L-shaped lever 158 has one arm kept in contact with the roller follower 156 and the other arm provided with a cam follower 159. Another bracket 160 is fixed to the rear side of the tool mounting frame 2, and a shaft 161 parallel to the quill axis is journaled in a bearing attached to the bracket 160. A disk cam 162 for contact with the cam follower 159 is fixed to one end of the shaft 161 and a bevel gear 163 is keyed onto the other end thereof (FIG. 22). The bevel gear 163 is meshed with a bevel gear 165, and the bevel gear 165 is keyed onto a corresponding end of a gear shaft 164 which extends through the central through-hole 2*b* in the tool mounting frame 2 in the direction parallel to the axis of the central through-hole 2*b* and which is journaled in a bearing incorporated in the bracket 160. A gear 166 is keyed onto the other end of the gear shaft 164, and is meshed with the large gear 4. The rotation of the large gear 4 is transmitted through the above-described gear train to the disk cam 162 and thus the disk cam 162 is caused to rotate, thereby moving the mandrel tools T2 toward and away from the quill axis within a restricted range.

Figure 23:
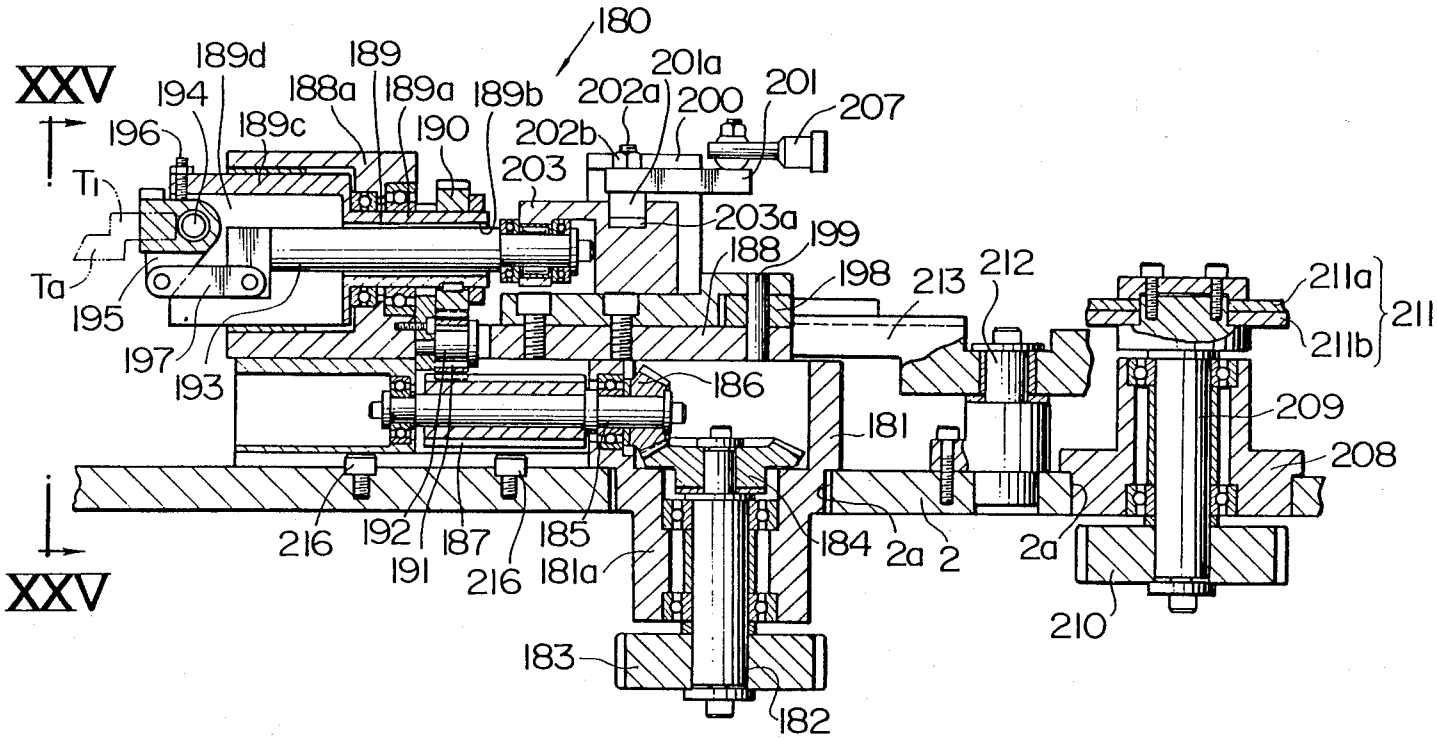
FIG. 23 is a diagrammatic vertical section of a forming tool unit incorporated in the fourth embodiment.
Figure 24:
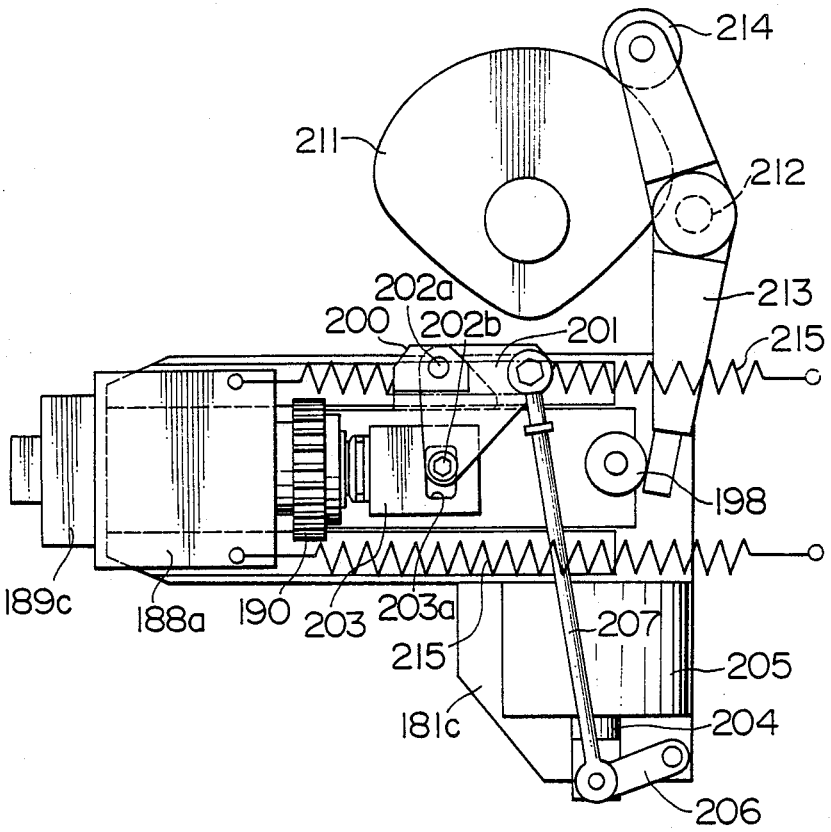
FIG. 24 is an enlarged plan view of the forming tool unit shown in FIG. 18.
Figure 25:
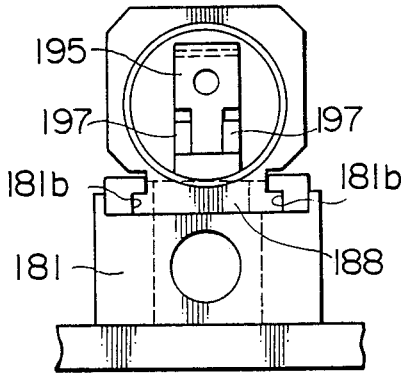
FIG. 25 is a schematic view taken along the line XXV—XXV of FIG. 23.

Referring to FIGS. 23, 24 and 25, the forming unit 180, which is constituted as a universal unit, is mounted on the tool mounting frame 2 in face-to-face relationship with the tip of the quill 12. A gear shaft 182 is rotatably supported by a bearing portion 181*a* which is incorporated in a unit support 181 concentrically with the mounting hole 2*a* and perpendicular to a mounting surface of the tool mounting frame 2 on which the unit support 181 is mounted. A small gear 183 which is meshed with the large gear 5 is keyed onto the projecting end portion of the gear shaft 182, while a bevel gear 184 is keyed onto the other end of the gear shaft 182. A gear shaft 185 is rotatably supported by bearing attached to the unit support 181 in such a manner that the longitudinal axis of the gear shaft 185 is perpendicular to that of the gear shaft 182 and parallel to the aforesaid mounting surface. A bevel gear 186 is keyed onto one end portion of the gear shaft 185, and is meshed with the bevel gear 184. A longitudinally extending gear 187 is keyed onto the remaining portion of the gear shaft 185. Guide ways **181*b* are formed over the top surface of the top surface of the unit support 181 in direction parallel to the gear shaft 185. A tool operating support 188 is slidably carried by the guide ways 181*b* (FIG. 25). An upper stage 188*a* is formed on the side of the tool operating support 188 nearer to the quill 12. A stepped operating cylinder 189 is supported for rotation about its axis by a combination of radial ball bearings and slide bearings attached to the upper stage 188*a*. The axis of rotation of the cylinder 189 coincides with the axis parallel to the direction in which the tool operating support 188 is slid, and, when the unit support 181 is mounted on the tool mounting frame 2, the rotation axis is aligned with the center axis of the quill 12. The stepped operating cylinder 189 is further supported by a thrust bearing so as to receive a reaction that acts upon a forming tool T1. A gear 190 is keyed onto a small diameter portion 189*a* of the stepped operating cylinder 189. A window is opened in the tool operating support 88 at a position there that corresponds to the gear 190, and an intermediate gear 191 which is meshed with the gears 190 and 187 is rotatably fitted onto a shaft 192. An axial through-hole 189*b* is formed in the small diameter portion 189*a* of the stepped operating cylinder 189, and a large diameter portion 189*c* of the stepped operating cylinder 189 has a deep groove 189*d* of a width equal to diameter of the axis through-hole 189*b* with one surface taken in the diametrical direction being left. An operating rod 193 extends through the axial through-hole 189*b* in the small diameter portion 189*a*, and the operating rod 193 is supported by slide bearings for rotation about, and reciprocal movement along, its longitudinal axis. A tool holder 195 which is slidably fitted into the deep groove 189*d* is swingably supported by a support shaft 194 in the vicinity of the inlet of the deep groove 189*d* and at a position nearer to the bottom of the deep groove 189*d* with respect to the axis of the operating rod 193. The forming tool T1 is replaceably attached to the tool holder 195 on the axis extending parallel to the center axis of the operating rod 193 and passing through the support shaft 194 so that the axis of the longitudinal axis of the forming tool T1 coincides with the axis of the guill 12**.

The forming tool T1 has the forming surface Ta which is located on the axis of the operating rod 193. The end of the tool holder 195 opposite to the support shaft 194 along the axis of the operating rod 193 is linked with an L-shaped end of the operating rod 193 by linkage plates 197. At the rear of the tool operating support 188, a cam follower 198 is rotatably supported by a shaft 199 which extends perpendicular to the direction in which the stepped operating cylinder 189 is slid. A lever stand 200 is disposed on the tool operating support 188 in an upright manner, and an L-shaped lever 201 is pivoted on a pivot shaft **202*a*. A sliding member 201*a* is rotatably secured to the underside of one arm of the L-shaped lever 201 by means of a bolt 202*b*. A slot 203*a* which extends substantially perpendicular to the quill axis is formed in a linkage member 203 which is connected to the rear end of the operating rod 193 for rotation with respect to the operating rod 193 through needle and thrust bearings, and the sliding member 201*a* is slidably fitted into the slot 203*a*. As shown in FIG. 24, a plate 181*c* extends from the unit support 181, and an air cylinder 205 having a piston rod 204 with an axis perpendicular to the quill axis is fixed to the extending plate 181*c*. A lever 206 is supported on a pivot shaft disposed on the extending plate 181*c*, and is engaged with the piston rod 204 in such a manner as to be pivoted by forward and backward movements of the piston rod 204. The lever 206 is linked to the L-shaped lever 201 by a rod 207. A stopper 196 is attached to the large diameter portion 189*c* of the stepped operating cylinder 189. The stopper 196 serves to hold the forming tool T1 at a predetermined position which faces the tip of the quill 12 when the tool holder 195 is rotated by the forward movement of the operating rod 193**.

A bearing housing 208 is attached to the mounting hole **2*a* formed in the tool mounting frame 2, and a cam shaft 209 is rotatably supported by the bearing housing 208 in such a manner as to extend parallel to the longitudinal axis of the gear shaft 182. A small gear 210 is keyed onto the end portion of the cam shaft 209 on the side on which the small gear 183 is located, and the small gear 210 is meshed with the large gear 4. Two cam plates 211*a* and 211*b* are secured to the other end of the cam shaft 209 for adjustment of the relative phase therebetween. These two cam plates constitute a composite cam 211**.

A lever shaft 212 is attached to the tool mounting frame 2 at an intermediate position thereof between the unit support 181 and the composition cam 211. A lever 213 is pivotably supported by the lever shaft 212 in such a manner that the displacement of the composite cam 211 is transmitted to the cam follower 198. As shown in FIG. 24, springs 215 are held in tension between pins fixed to the upper stage **188*a* of the tool operating support 188 and pins fixed to the tool mounting frame 2 so as to keep contact between the cam follower 198 and the lever 213 as well as the cam follower 214 of the lever 213 and the composite cam 211. The forming unit 180 having the above-described arrangement is radially positioned by dowel pins 216 on the tool mounting frame 2 in such a manner that the tool T1 faces the quill 12 as shown in FIG. 18**.

Figure 27:
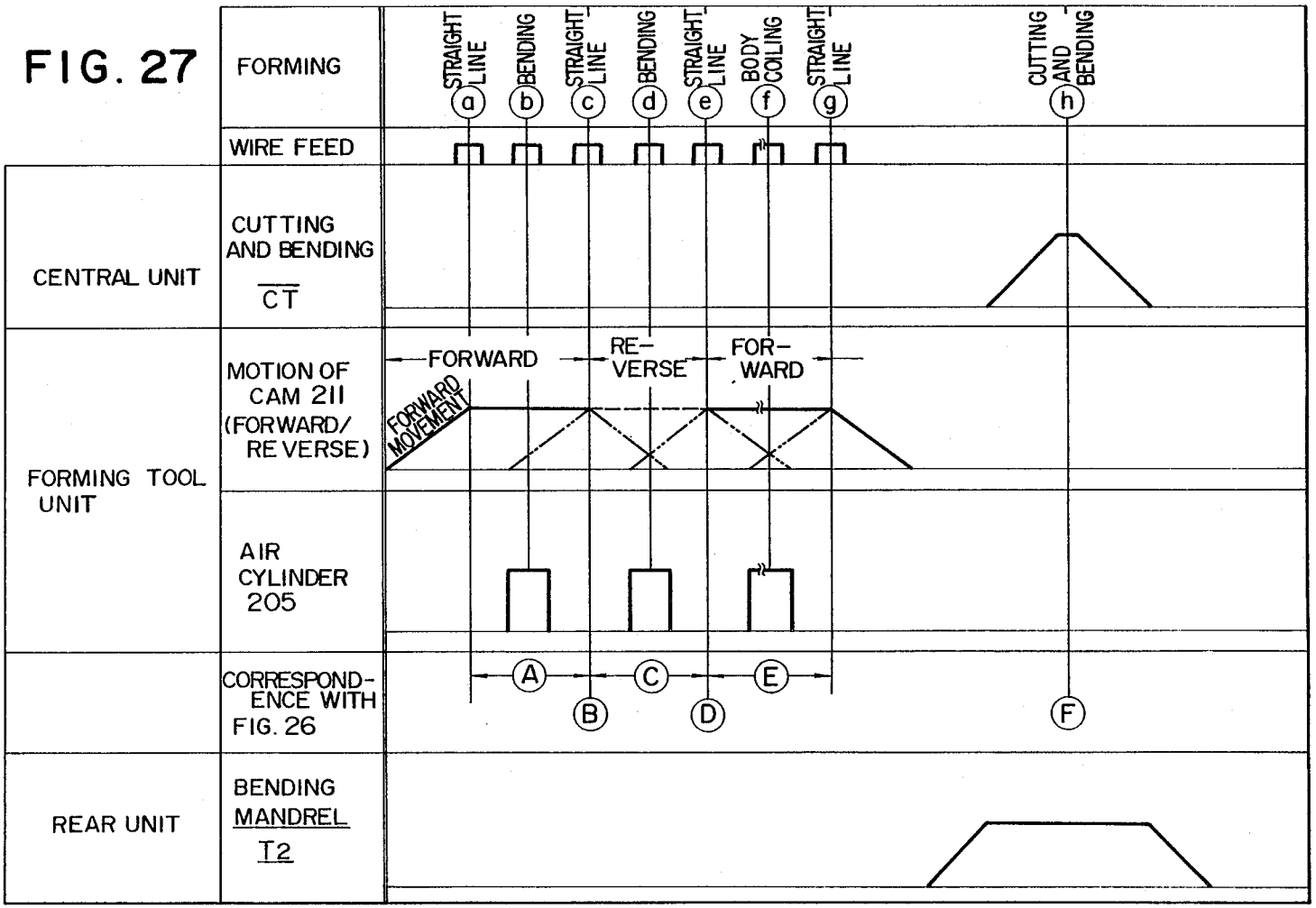
FIG. 27 is a chart illustrating the manner of time sharing relative to the operation of the central unit, the forming tool unit, the air cylinder and the rear unit incorporated in the fourth embodiment.

A method of producing a torsion coil spring such as that shown in FIGS. 28A and 28B by means of the above-described embodiment will be described below with reference to FIG. 26 which is a control chart as well as FIG. 27 which illustrates each step of the production process.

As illustrated, although the two mandrel units 150 each having the same arrangement are used in this embodiment, it is assumed hereinafter that the upper one is employed to form a torsion coil spring, by way of example.

First, the angle of the support 121 is adjusted and fixed by the bolt **121*b* in accordance with the angle of twist between the straight portion (g) and the straight portion (h) of the second hook of a desired torsion spring. Then, the wire feed roller 14 is caused to rotate by the drive of the servo motor 11 which receives a command supplied from a numerical control device (not shown), thereby feeding the straight portion (a) of the end of the first hook of the spring. Then, the large gear 4** is caused to rotate by the drive of the servo motor 7 which receives a command supplied from the numerical control device (not shown), thereby causing the small gear 210 to rotate. Thus, the composite cam 211 of the cam shaft 209 is caused to rotate. The cam surface of the composite cam 211 causes the lever 213 to rotate, thereby causing the tool operating support 188 to move forwardly toward the quill 12 through the cam follower 198. This forward movement causes the operating cylinder 188 together with the forming tool T1 to move from preliminary position to standby position. When the cam shaft 209 is rotated through a predetermined angle in accordance with a command indicative of rotation, compressed air is fed to the rear chamber in the air cylinder 205 to cause the piston rod 207 to move forwardly and hence the L-shaped lever 201 to be rotated through the linkage member 203, thereby causing the operating rod 193 to move forwardly toward the quill 12. Therefore, the linkage plates 197 causes the tool holder 195 to swing about the support shaft 194, thereby causing the forming tool T1 to swing about the support shaft 194 from its standby position (shown by a phantom line in FIG. 26A) to a position which faces the tip of the quill 12 (FIG. 26A). Thus, the forming surface Ta is applied to the wire fed from the quill 2 and forms it into the bent portion (b) of the first hook. After a ¼ circle has been formed, compressed air in the air cylinder 205 is moved from the rear chamber to the front chamber to cause the piston rod 204 to move backwardly and hence the L-shaped lever 201 to reverse, thereby causing the linkage member 203 and the operating rod 193 to move backwardly. Thus, the forming tool T1 is reversed to its standby position. During this time, since the composite cam 211 has a wide working surface, the cam 211 is still maintained in its working position.

Then, the large gear 5 is caused to rotate by the drive of the servo motor 9 which receives a command supplied from the numerical control device (not shown), and thus the wheel 190 is rotated through 90° through the intermediary of the small gear 183, the gear shaft 182, the bevel gears 184 and 186, the gear shaft 185, and the gears 187 and 191. This 90° rotation is transmitted through the operating rod 189 to the operating cylinder 193, and the operating cylinder 193 is also rotated through 90°. Thus, the tool holder 195 and the forming tool T1 are rotated through 90° about the axis of the quill 12 (FIG. 8B). Further, the wire feed roller 14 is rotated by the drive of the servo motor 11 to feed the wire, and thus a straight portion (c) which serves as an engagement portion of the first hook is formed.

When the servo motor 7 is reversed to cause the large gear 4 to rotate in the reverse direction, the composite cam 211 is reversed in such a manner that its working surface keeps the lever 213 in contact with the cam follower 198, so that the tool operating support 188 is held in its forward standby position. When the cam shaft 209 reaches a predetermined angular position, the compressed air in the air cylinder 205 is moved from the front chamber to the rear chamber to cause the piston rod 204 to move forwardly and hence the L-shaped lever 201 to swing, thereby causing the linkage member 203 and the operating rod 193 to move forwardly. Therefore, the tool holder 195 and the forming tool T1 are swung and are moved to a position which faces the tip of the quill 12 from the direction which is 90° offset from the previous position, and the forming tool T1 is applied to the wire fed from the quill 12 to form it into a bent portion (d) (FIG. 26C). When a quarter circle has been formed, the pressure in the air cylinder 205 is moved from the rear chamber to the front chamber to cause the operating rod 193 to move backwardly through the intermediary of the rod 207, the L-shaped lever 201 and the linkage member 203. Thus, the forming tool T1 is caused to swing about the shaft 194 in the reverse direction to its standby position. The composite cam 211 is still held in position such that its working surface is kept in contact with its corresponding element. When the servo motor 9 is actuated to cause the large gear 5 to rotate, the wheel 190 is further rotated through 90° through the intermediary of the small gear 183, the bevel gears 184 and 186, and the gears 187 and 191. Therefore, the stepped operating cylinder 189 and the operating cylinder 193 are further rotated through 90° about the axis of the quill 12 (FIG. 26D). In this state, the wire feed roller 14 is rotated by actuating the servo motor 11 to feed the wire, and thus the straight portion (e) which constitutes a leg of the first hook is produced.

When the servo motor 7 is forwardly actuated, the small gear 210 and the composite cam 211 are caused to rotate by the rotation of the large gear 4. More specifically, the composite cam 211 is a reversed to cause its working surface to move in the forward direction. When the composite cam 209 reaches a predetermined angular position of the cam shaft 209, the compressed air in the air cylinder 205 is moved from the front chamber to the rear chamber to cause the operating rod 193 to move forwardly. Thus, the forming tool T1 is swung about the support shaft 194 from the position at which it is rotated through 90°, to a position which faces the tip of the quill 12. The servo motor 11 is actuated to rotate the wire feed roller 14, feed the wire from the quill 12, press it again the forming surface Ta of the forming tool T1, and form the coil body (f) (FIG. 26E). If a long coil body is needed, the servo motor 7 is stopped and the composite cam 211 is held in position such that the working surface of the composite cam 211 is kept in contact with the corresponding element. When a desired number of turns are formed, the compressed air in the cylinder 205 is moved from the rear chamber to the front chamber to cause the operating rod 193 to move backwardly, thereby causing the tool holder 195 and the forming tool T1 to rotate to the standby position. The wire feed roller 14 is rotated by the drive of the servo motor 11 to feed the wire from the quill 12, and thus a straight portion (g) of the leg of the second hook is produced.

Then, the cam plate 162 is rotated by the rotation of the large gear 4 through the gear train constituted by the gear 166, the bevel gears 165 and 163, thereby causing the L-shaped lever 158 to rotate. Thus, the holder 155 of the upper mandrel T2 is moved up to a position at which the mandrel T2 comes into contact with the wire fed from the quill 12. In the meantime, the disk cam 133 is rotated by the rotation of the large gear 4 through the gear trains constituted by the gears 138, 137, 135, and the bevel gears 134 and 132 to cause the cam follower 124 and the roller followr 125 to move upwardly along the guide rod 122, thereby causing the lever 128 to rotate and the holder 126 to move downwardly, that is, toward the wire fed from the quill 12. Thus, the cutting/bending tool CT' is moved forwardly to cut the wire in cooperation with the quill 12 and to a end portion (h) at a predetermined angle of twist in cooperation with the mandrel tool T2 (FIG. 26F).

As described above in detail, in this embodiment, the cutting/bending unit is disposed so that the rotational position thereof may be determined in a plane perpendicular to the quill axis, and the mandrel tools are disposed in side-by-side relationship so that they can be moved toward and away from the quill through the central through-hole along a predetermined course extending from the rear side of the tool mounting frame. Accordingly, it is possible to form a torsion spring having an angle of twist between first and second hooks thereof and also modifications in the angle of twist can be readily accomplished. In addition, since the mandrels and associated parts are disposed in a manner to project from the rear to front sides, substantial limitations are eliminated from design in a tool mounting portion. This leads to an advantage that a multiplicity of tools can be mounted without the risk of interfering with other forming tools.

Although this embodiment has been described as employing the cutting/bending tool CT' in the central unit and the mandrel tool $T_2$ in the rear unit, it should be understood that any desired tools may be attached to the holder 126 of the central unit and the holder 155 of the rear unit, respectively.

What is claimed is:

1. An apparatus for forming a coil spring, comprising:

a quill having a longitudinal axis and a tip through which a wire to be formed into said coil spring is fed;

a tool assembly disposed opposite said quill and including a tool operating support for slidable movement along the axis of said quill, an operating cylinder supported on said tool operating support for rotation about the axis of said quill, a tool holder supported on said operating cylinder for swinging movement about an axis perpendicular to the axis of said quill, a forming tool securely held at one end of said tool holder and having a forming surface, and an operating rod operatively connected to the other end of said tool holder and supported for forward and backward movements with respect to said operating cylinder along the axis of said quill;

first drive means for moving said operating support toward and away from said quill;

second drive means for rotating said operating cylinder about the axis of said quill with respect to said operating support;

third drive means for moving said operating rod to swing said tool holder between a first position at which said forming surface of said forming tool is located outside the axis of said quill and a second position at which said forming surface is located to confront said tip of said quill;

fourth drive means for feeding the wire through said tip of said quill; and control means for controlling operation of said first, second, third and fourth drive means.

2. An apparatus according to claim 1, wherein said operating rod is arranged in the operating cylinder such that it is unrotatable with respect to said operating cylinder, and said second drive means is operatively connected to said operating rod to rotate the operating rod and operation cylinder about the axis of said quill.

3. The apparatus according to claim 1, wherein said control means is a numerical control device.

4. The apparatus according to claim 1, wherein said tool assembly is mounted on a front side of a tool mounting frame having a planar form, said tool mounting frame having a hole whose center axis extends substantially through said tip of said quill at right angles to said axis of said quill.

5. The apparatus according to claim 4, wherein said first drive means includes a first large gear driven by a first servo motor and supported on a rear side of said tool mounting frame for rotation about said center axis of said hole; and wherein said second drive means includes a second large gear driven by a second servo motor and supported on the rear side of said tool mounting frame for rotation with respect to said first large gear about said axis of said first large gear.

6. The apparatus according to claim 5, wherein said first drive means further includes first and second cams driven by said first large gear; and a cam follower mounted on said tool operating support for cooperating with said first cam to move said tool operating support, and wherein said second drive means further includes a transmission mechanism for transmitting the rotation of said second large gear to said operating cylinder.

7. The apparatus according to claim 5, wherein said first drive means further includes a cam driven by said first large gear; a cam follower mounted on said tool operating support for cooperating with said cam to move said tool operating support; and an air cylinder for causing movement of said operating rod, and wherein said second drive means further includes a transmission mechanism for transmitting the rotation of said second large gear to said operating cylinder.

8. The apparatus according to claim 5 further comprising a central unit mounted on the front side of said tool mounting frame and a rear unit, said central unit including:

a support mounted adjacent to said hole on the front side of said tool mounting frame with the angle of said support with respect to the front surface of said tool mounting frame being adjustable about said axis of said quill;

a tool holder supported for movement along a slanting surface of said support in the radial direction; and a second tool fastened to one end of said tool holder of said central unit for movements toward and away from the tip of said quill, and said rear unit including:

a rear tool holder supported by said tool mounting frame for movements along a predetermined course extending through said hole from the rear side to the front side of said tool mounting frame; and a third tool fastened to the tip of said rear tool holder.

9. The apparatus according to claim 8, wherein said tool holder of said central unit and said rear tool holder are respectively operated by separate cams associated with said first large gear.

10. The apparatus according to claim 8, wherein said second tool is a cutting/bending tool and said third tool is a mandrel to cooperate, at its forward position, with said cutting/bending tool to bend a wire fed from said quill at a predetermined angle of twist.

* * * * *